US008764496B2

(12) United States Patent
Todo et al.

(10) Patent No.: US 8,764,496 B2
(45) Date of Patent: Jul. 1, 2014

(54) AIRBAG ELECTRICAL CONNECTOR FOR IMPROVED CONTACT RELIABILITY

(75) Inventors: Nobuhisa Todo, Tokyo (JP); Yuji Hamaoka, Tokyo (JP); Akira Ohno, Tokyo (JP)

(73) Assignee: Japan Aviation Electronics Industry, Ltd., Tokyo (JP)

( * ) Notice: Subject to any disclaimer, the term of this patent is extended or adjusted under 35 U.S.C. 154(b) by 72 days.

(21) Appl. No.: 13/567,208

(22) Filed: Aug. 6, 2012

(65) Prior Publication Data

US 2013/0224987 A1 Aug. 29, 2013

(30) Foreign Application Priority Data

Feb. 24, 2012 (JP) ..... 2012-038242

(51) Int. Cl.
*H01R 11/22* (2006.01)

(52) U.S. Cl.
USPC ..... 439/852; 439/595

(58) Field of Classification Search
USPC ..... 439/839, 843, 845, 851, 852, 595
See application file for complete search history.

(56) References Cited

U.S. PATENT DOCUMENTS

| | | | | |
|---|---|---|---|---|
| 5,647,754 | A * | 7/1997 | Kohno | 439/188 |
| 6,361,341 | B1 * | 3/2002 | Okayasu et al. | 439/271 |
| 7,275,946 | B2 * | 10/2007 | Ohtaka et al. | 439/188 |
| 7,481,685 | B2 * | 1/2009 | Fukaya et al. | 439/852 |
| 8,152,576 | B2 * | 4/2012 | Nakamura et al. | 439/852 |
| 8,206,187 | B2 * | 6/2012 | Nakamura et al. | 439/852 |
| 8,333,622 | B2 * | 12/2012 | Blasko et al. | 439/852 |

FOREIGN PATENT DOCUMENTS

JP 2007-123232 A 5/2007

* cited by examiner

*Primary Examiner* — Thanh Tam Le
(74) *Attorney, Agent, or Firm* — Maier & Maier, PLLC

(57) ABSTRACT

Provided is a technique for improving connection reliability. A contact part that contacts with a detecting male contact is formed in a detecting collision spring piece. The detecting male contact includes a contact surface that contacts with the contact part. The detecting collision spring piece is elastically deformed in advance so that a gap is formed between the contact part and the contact surface when the contact part is opposed to the contact surface in a height direction. When an elastic deformation force that elastically deforms the detecting collision spring piece is released, the contact part contacts with the contact surface with collision against the contact surface due to a spring restoring force of the detecting collision spring piece. A locus of the contact part just before the contact part collides with the contact surface is oblique with respect to the contact surface when seen from a mate direction.

16 Claims, 24 Drawing Sheets

AIRBAG ELECTRICAL CONNECTOR FOR IMPROVED CONTACT RELIABILITY

RELATED APPLICATIONS

This application claims priority under 35 U.S.C. §119 to Japanese Patent Application No. 2012-038242, filed Feb. 24, 2012, the disclosure of which is incorporated by reference herein in its entirety.

BACKGROUND OF THE INVENTION

1. Field of the Invention

The present invention relates to an electrical connector.

2. Description of Related Art

As a related art, Japanese Unexamined Patent Application Publication No. 2007-123232 discloses, as shown in FIG. 23, an airbag connector including a male connector housing 100 and a female connector housing 101. Contact terminals 102 are provided in the connector housing 100 so as to project from the connector housing 100. A detecting-terminal accommodating part 103 is formed in the connector housing 101. A detecting terminal 104 is accommodated in the detecting-terminal accommodating part 103. The detecting terminal 104 includes a base plate 105 arranged along the inner surface of the detecting-terminal accommodating part 103, and a first spring 106 that extends backward with an upward inclination from the front end of the base plate 105.

FIG. 23 shows a state before the connector housing 100 and the connector housing 101 are mated properly. In this state, the first spring 106 is resiliently displaced in a position away from the contact terminal 102. FIG. 24 shows a state in which the connector housing 100 and the connector housing 101 are mated properly. In this state, the first spring 106 contacts with the contact terminal 102 by a spring restoring force. With the structure stated above, the contact between the first spring 106 and the contact terminal 102 is electrically detected, thereby being able to electrically detect the state in which the connector housing 100 and the connector housing 101 are mated properly.

SUMMARY OF THE INVENTION

The present inventors have found, however, that the structure disclosed in Japanese Unexamined Patent Application Publication No. 2007-123232 still remains room for improvement in reliability of the contact between the contact terminal 102 and the first spring 106.

One exemplary object of the present invention is to provide a technique for improving contact reliability.

According to an exemplary aspect of the present invention, there is provided an electrical connector including: a first connector part including a first housing, and a first contact held by the first housing; and a second connector part including a second housing, and a second contact held by the second housing, in which the first connector part and the second connector part are mated to make the first contact and the second contact each other, the first contact includes a holding part held by the first housing and a spring piece supported by the holding part to be capable of being elastically deformed, a contact part that contacts with the second contact is formed in the spring piece, the second contact includes a contact surface that contacts with the contact part, the spring piece is elastically deformed so that a gap is formed between the contact part and the contact surface when the contact part is opposed to the contact surface, and the contact part contacts with the contact surface when an elastic deformation force that elastically deforms the spring piece is released, and a locus of the contact part just before the contact part contacts with the contact surface is oblique with respect to the contact surface when seen from a mate direction as a direction of relative displacement of the second connector part seen from the first connector part when the first connector part and the second connector part are mated.

Preferably, the first contact is formed by folding a metal plate, and the contact part is elastically displaced to a direction different from a plate thickness direction of the spring piece when seen from the mate direction so that the gap is formed between the contact part and the contact surface when the contact part is opposed to the contact surface.

Preferably, the first contact includes an interference part that physically interferes with the spring piece when the spring piece is elastically deformed so that the gap is formed between the contact part and the contact surface when the contact part is opposed to the contact surface, and a sloped surface that is inclined with respect to the plate thickness direction of the spring piece when seen from the mate direction is formed in at least one of the spring piece and the interference part, the sloped surface being able to contact with the other one of the spring piece and the interference part.

Preferably, the first housing includes an interference part that physically interferes with the spring piece when the spring piece is elastically deformed so that the gap is formed between the contact part and the contact surface when the contact part is opposed to the contact surface, and a sloped surface that is inclined with respect to the plate thickness direction of the spring piece when seen from the mate direction is formed in at least one of the spring piece and the interference part, the sloped surface being able to contact with the other one of the spring piece and the interference part.

Preferably, the first housing includes a pressing part that elastically deforms the spring piece so that the gap is formed between the contact part and the contact surface when the contact part is opposed to the contact surface, and the pressing part is restored and the elastic deformation force is released when the first connector part and the second connector part are mated properly.

Preferably, the first housing includes a pressing part that elastically deforms the spring piece so that the gap is formed between the contact part and the contact surface when the contact part is opposed to the contact surface, and a sloped surface that is inclined with respect to the plate thickness direction of the spring piece when seen from the mate direction is formed in at least one of the spring piece and the pressing part, the sloped surface being able to contact with the other one of the spring piece and the pressing part.

Preferably, the pressing part is restored and the elastic deformation force is released when the first connector part and the second connector part are mated properly.

Preferably, the first contact is formed by folding a metal plate, and the contact surface of the second contact is inclined with respect to a plate thickness direction of the spring piece when seen from the mate direction.

Preferably, the first housing includes a pressing part that elastically deforms the spring piece so that the gap is formed between the contact part and the contact surface when the contact part is opposed to the contact surface, and the pressing part is restored and the elastic deformation force is released when the first connector part and the second connector part are mated properly.

Preferably, the electrical connector further includes an excessive deformation preventing part that physically interferes with the spring piece when the spring piece is elastically deformed to prevent excessive elastic deformation of the spring piece.

Preferably, the excessive deformation preventing part is formed in the first contact.

Preferably, the holding part includes a bottom plate part.

Preferably, the holding part includes a bottom plate part and a pair of side plate parts connected to the bottom plate part to form a U shape when seen from the mate direction.

Preferably, a cutout is formed in the bottom plate part to prevent physical interference between the spring piece and the bottom plate part when the spring piece is elastically deformed so that the gap is formed between the contact part and the contact surface when the contact part is opposed to the contact surface.

Preferably, the first contact further includes a second spring piece supported by the holding part to be capable of being elastically deformed, a contact part that contacts with a mating contact is formed in the second spring piece, and the second spring piece is elastically deformed to be pushed away to a direction away from the mating contact when the contact part of the second spring piece contacts with the mating contact.

Preferably, the holding part of the first contact includes a bottom plate part, and the spring piece includes a pressed part pressed by the pressing part and a front end part having the contact part formed therein in series from the bottom plate part.

According to the present invention, the contact part is displaced while being contacted with the contact surface when the contact part contacts the contact surface. Accordingly, a so-called wiping effect is exerted, thereby achieving high connection reliability between the first contact and the second contact.

The above and other objects, features and advantages of the present invention will become more fully understood from the detailed description given hereinbelow and the accompanying drawings which are given by way of illustration only, and thus are not to be considered as limiting the present invention.

DESCRIPTION OF THE EXEMPLARY EMBODIMENTS

First Exemplary Embodiment

Hereinafter, with reference to FIGS. 1 to 19, a first exemplary embodiment of the present invention will be described.

Figure 1:
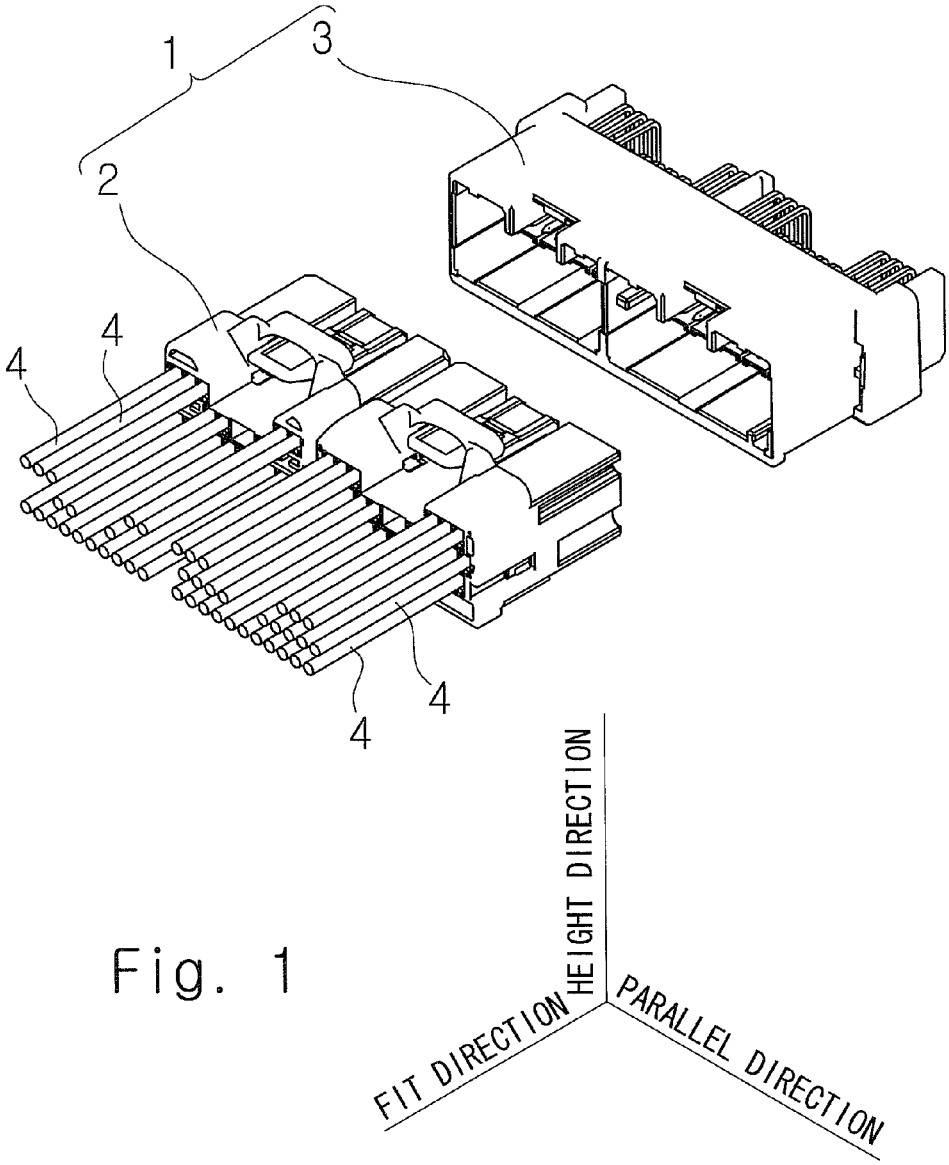
FIG. 1 is a perspective view of an airbag electrical connector (first exemplary embodiment)
Figure 2:
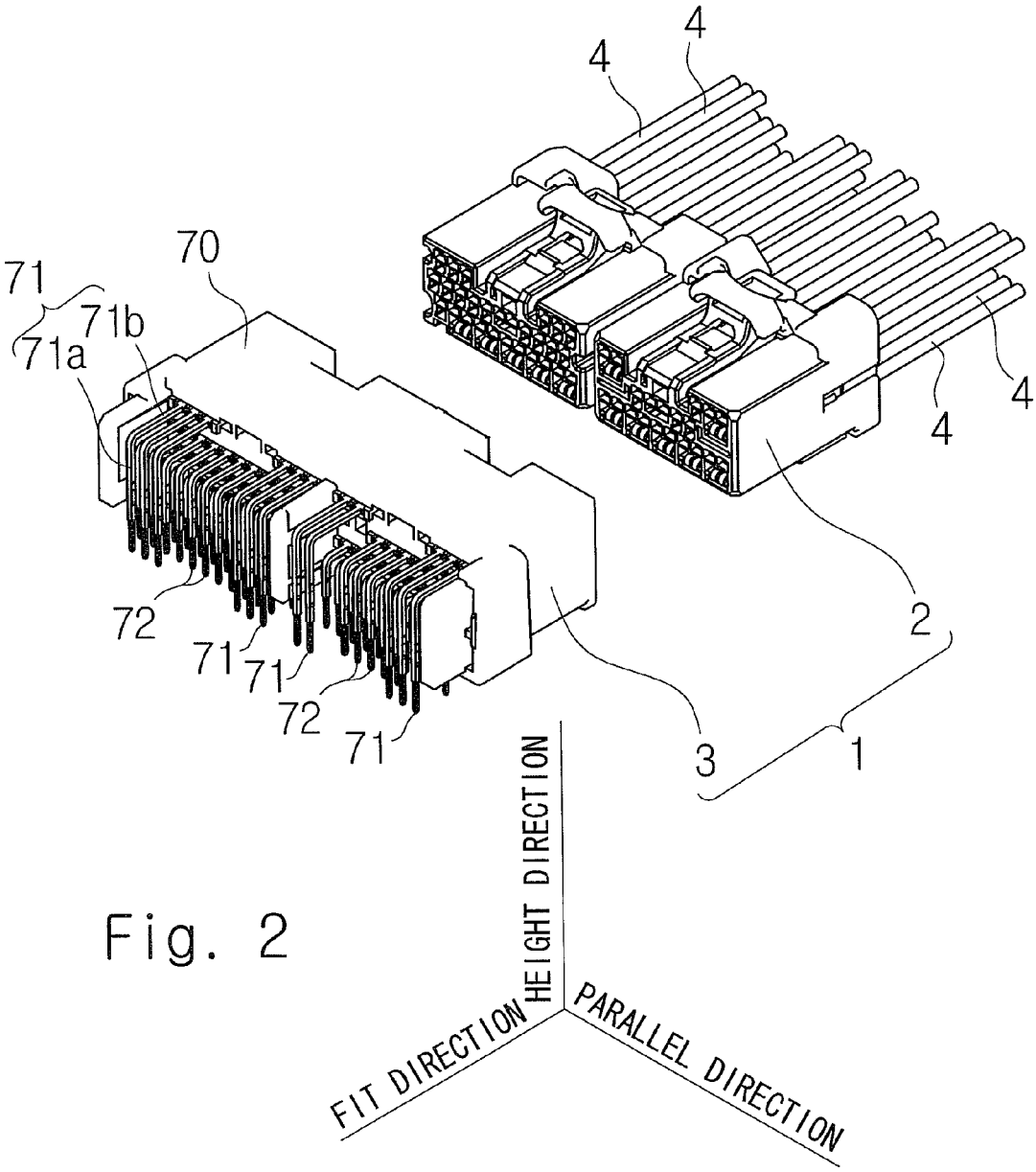
FIG. 2 is a perspective view of the airbag electrical connector seen from a different angle (first exemplary embodiment)

As shown in FIGS. 1 and 2, an airbag electrical connector 1 (electrical connector) includes a female connector 2 (first connector part) and a male connector 3 (second connector part). A plurality of cables 4 are connected to the female connector 2. The male connector 3 is mounted on a circuit board (not shown). The female connector 2 is mated with the male connector 3, whereby the plurality of cables 4 connected to the female connector 2 are electrically connected to the circuit board. While the female connector 2 is provided in each of right and left sides, only one female connector 2 will be described as shown in FIG. 3 and description of one of the spring piece and the interference part will be omitted in the following description.

(Female Connector 2)

Figure 3:
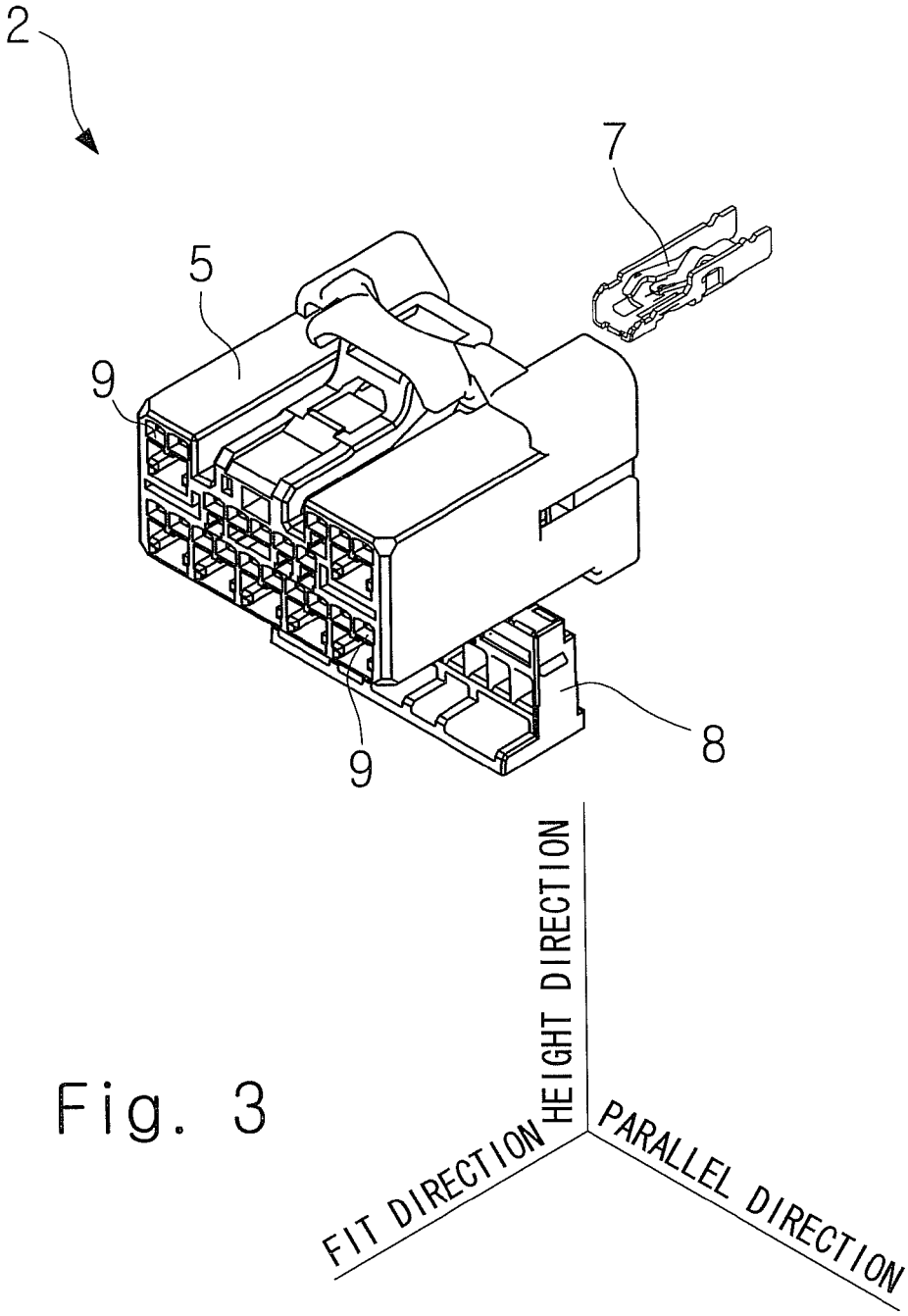
FIG. 3 is an exploded perspective view of a female connector (first exemplary embodiment)

As shown in FIG. 3, the female connector 2 includes a female housing 5 (first housing), a detecting female contact 7 (first contact), and a retainer 8.

The female housing 5 is provided to hold the detecting female contact 7 and the cables 4 each having an end part to which a socket contact (not shown) is attached thereto. The female housing 5 is formed of an insulating material such as a resin. In the female housing 5, a plurality of signal female contact accommodating parts 9 and one detecting female contact accommodating part 10 (see also FIG. 9) are formed. Each of the signal female contact accommodating parts 9 accommodates a socket contact attached to each cable 4. Each of the detecting female contact accommodating parts 10 accommodates the detecting female contact 7.

The detecting female contact 7 detects whether the female connector 2 and the male connector 3 are mated properly.

Figure 9:
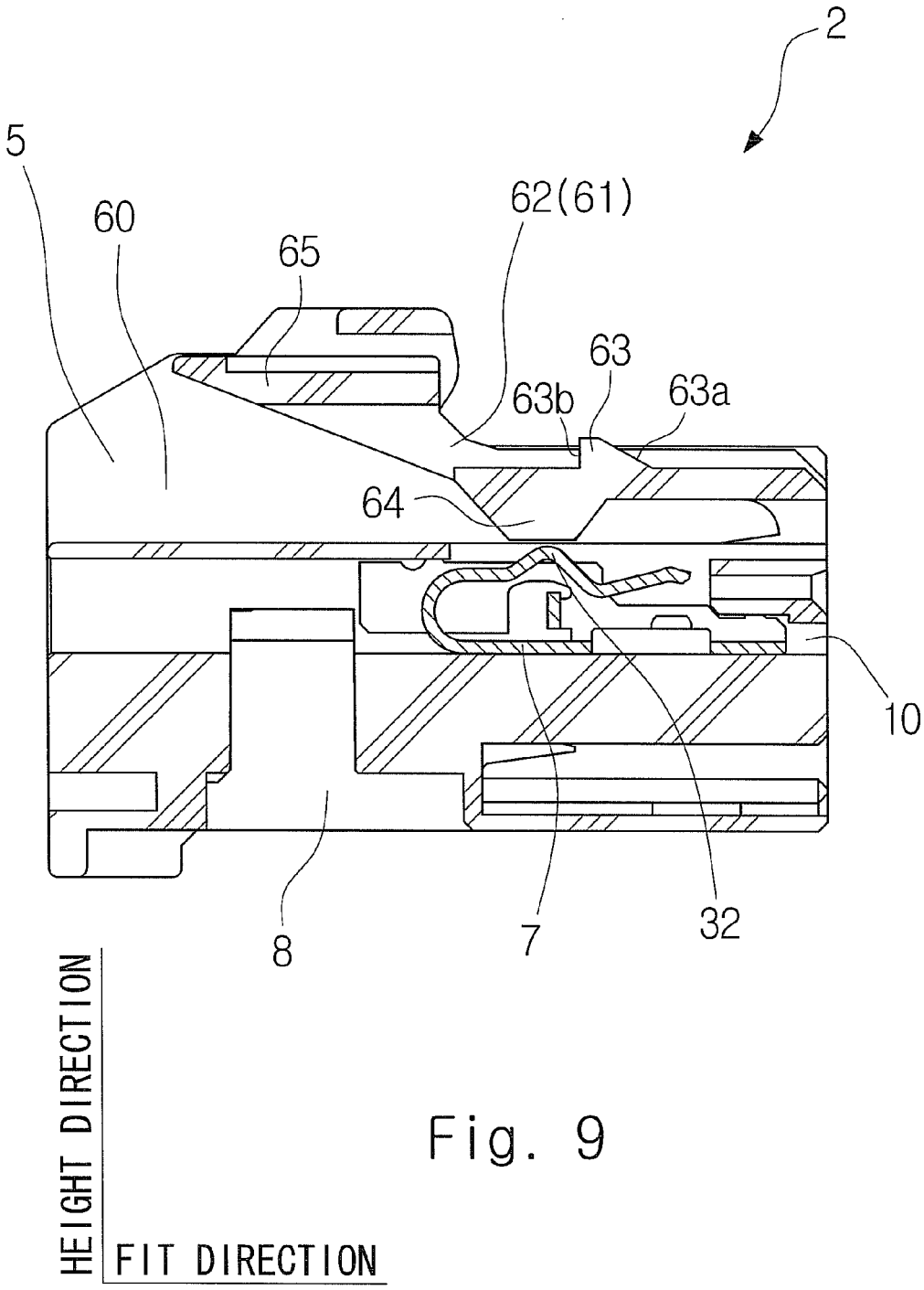
FIG. 9 is a cross-sectional side view of the female connector (first exemplary embodiment)

The retainer 8 is inserted into the female housing 5, thereby preventing the socket contact attached to each cable 4 and the detecting female contact 7 from being fallen off (see also FIG. 9).

Here, a "mate direction" is defined. The "mate direction" is, as shown in FIGS. 1 and 2, a direction in which the male connector 3 is relatively displaced when seen from the female connector 2 when the female connector 2 and the male connector 3 are mated. Regarding the "mate direction", the direction from the female connector 2 to the male connector 3 is denoted by a "female connector insertion direction", and the direction from the male connector 3 to the female connector 2 is denoted by a "female connector removal direction" in a state before the female connector 2 and the male connector 3 are mated as shown in FIGS. 1 and 2. In short, when the female connector 2 is displaced to the female connector insertion direction in the state shown in FIGS. 1 and 2, the female connector 2 is mated with the male connector 3.

(Detecting Female Contact 7)

Figure 4:
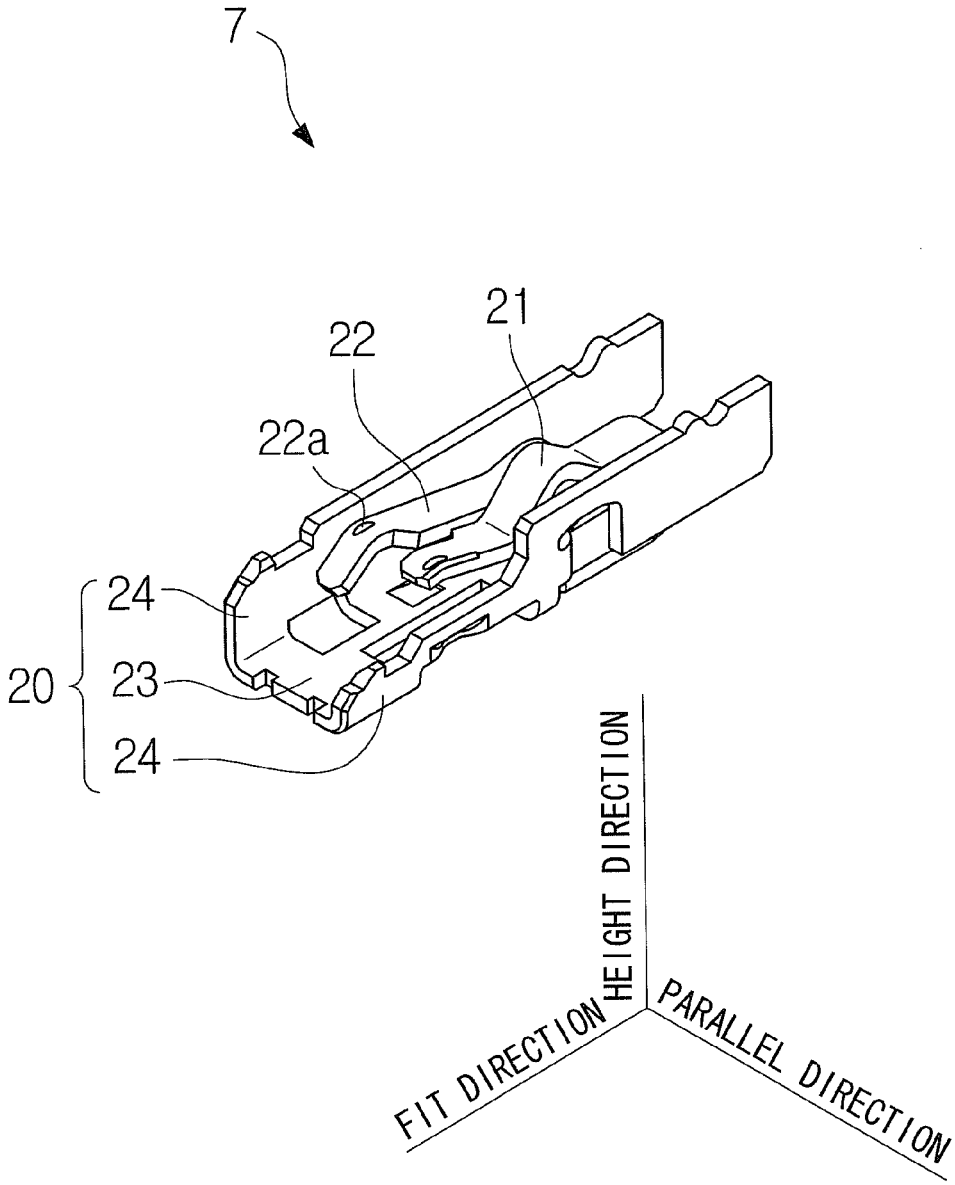
FIG. 4 is a perspective view of a detecting female contact (first exemplary embodiment)

Next, the detecting female contact 7 will be described in detail. The detecting female contact 7 is formed by folding a metal plate as shown in FIG. 4. The detecting female contact 7 is subjected to surface processing such as tin plating.

The detecting female contact 7 includes a holding part 20, a detecting collision spring piece 21 (spring piece, first spring piece), and a detecting normal spring piece 22 (second spring piece).

The holding part 20 is a part held by the female housing 5. The holding part 20 includes a bottom plate part 23 and a pair of side plate parts 24. The bottom plate part 23 is a flat plate body having a substantially rectangular shape which is elongated along the mate direction. Each of the pair of side plate parts 24 is also an elongated plate body along the mate direction. The pair of side plate parts 24 are each connected to an edge of the bottom plate part 23 on the long side, and are formed to be folded substantially at right angle in the same direction with respect to the bottom plate part 23. In short, the bottom plate part 23 and the pair of side plate parts 24 form a substantially U shape when seen from the mate direction.

The detecting collision spring piece 21 and the detecting normal spring piece 22 are both arranged between the pair of side plate parts 24.

The detecting collision spring piece 21 is a cantilevered spring piece supported by the holding part 20 to be capable of being elastically deformed. The detecting collision spring piece 21 is connected to an end part of the bottom plate part 23 on the side of the female connector removal direction, and elongated to the side of the female connector insertion direction.

The detecting normal spring piece 22 is a cantilevered spring piece supported by the holding part 20 to be capable of being elastically deformed. The detecting normal spring piece 22 is connected to an end part of the bottom plate part 23 on the side of the female connector removal direction, and elongated to the side of the female connector insertion direction. In the detecting normal spring piece 22, a contact part 22*a* that contacts with a detecting male contact 72 (mating contact) described later is formed.

Then, the detecting collision spring piece 21 and the detecting normal spring piece 22 are arranged in the direction in which the pair of side plate parts 24 are opposed to each other.

Now, a "parallel direction" and a "height direction" will be defined. The "parallel direction" is a direction perpendicular to the mate direction, and is a direction in which the detecting collision spring piece 21 and the detecting normal spring piece 22 are arranged. Regarding the "parallel direction", the direction from the detecting collision spring piece 21 to the detecting normal spring piece 22 is denoted by a "collision normal direction", and the direction from the detecting normal spring piece 22 to the detecting collision spring piece 21 is denoted by a "normal collision direction". The "height direction" is a direction that is perpendicular to the mate direction and the parallel direction, and corresponds to a plate thickness direction of the detecting collision spring piece 21 when the detecting female contact 7 is seen from the mate direction. Regarding the "height direction", the direction from the detecting collision spring piece 21 and the detecting normal spring piece 22 to the bottom plate part 23 is denoted by a "bottom plate approach direction", and the direction from the bottom plate part 23 to the detecting collision spring piece 21 and the detecting normal spring piece 22 is denoted by a "bottom plate apart direction". Note that the plate thickness direction of the detecting collision spring piece 21 when the detecting female contact 7 is seen from the mate direction corresponds to the plate thickness direction of the bottom plate part 23.

Figure 5:
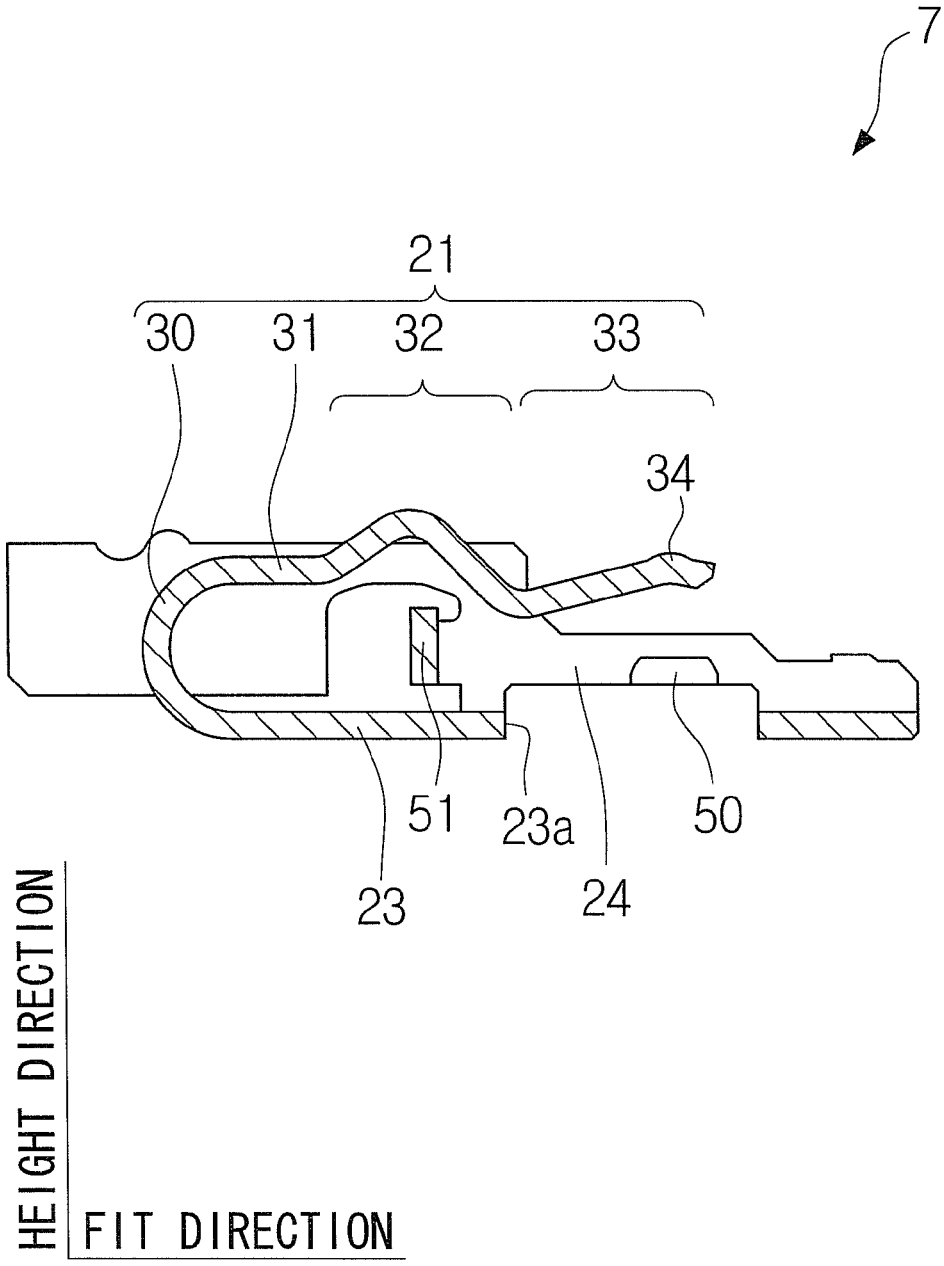
FIG. 5 is a cross-sectional view taken along the line V-V of FIG. 6 (first exemplary embodiment)

FIG. 5 shows the detecting collision spring piece 21 in an unloaded condition. As shown in FIG. 5, the detecting collision spring piece 21 includes a folded part 30, a parallel part 31, a pressed part 32, and a front end part 33 in this order along the female connector insertion direction.

The folded part 30 is a part connected to an end part of the bottom plate part 23 on the side of the female connector removal direction, and is a part in which the detecting collision spring piece 21 is folded by about 180 degrees to the side of the bottom plate apart direction.

The parallel part 31 is a part connected to the folded part 30 and extending along the mate direction.

The pressed part 32 is a part connected to the parallel part 31, and bent substantially in an inverted V shape to the bottom plate apart direction.

Figure 6:
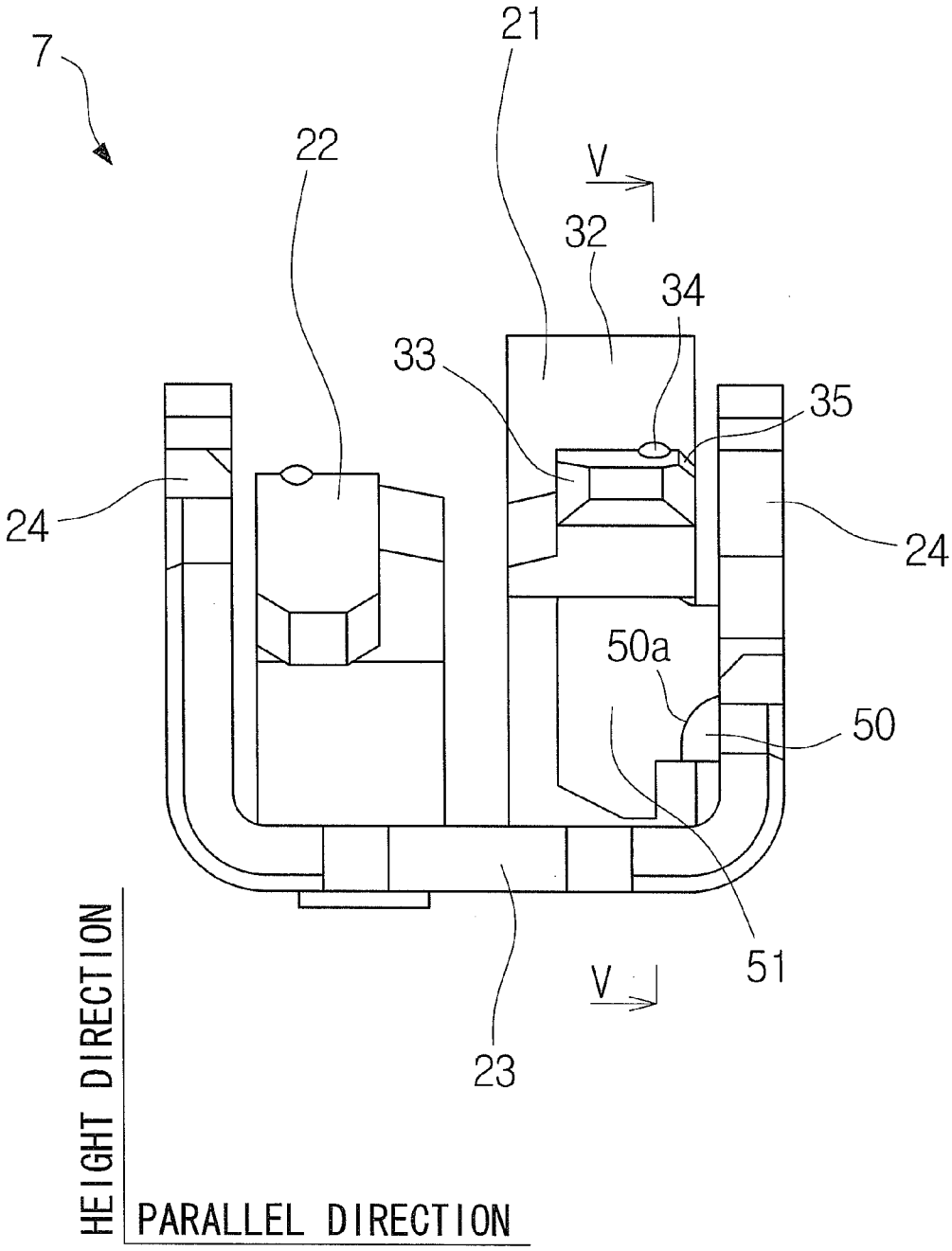
FIG. 6 is a front view of the detecting female contact (first exemplary embodiment)

The front end part 33 is a part connected to the pressed part 32, and inclined to be away from the bottom plate part 23 toward the female connector insertion direction. A contact part 34 that swells in a spherical shape to the bottom plate apart direction is formed on the surface that faces the opposite side from the bottom plate part 23 near the tip of the front end part 33. Further, as shown in FIG. 6, a sloped surface 35 (chamfer edge) is formed at a corner on the side of the bottom plate apart direction on the side of the normal collision direction of the front end part 33.

Figure 7:
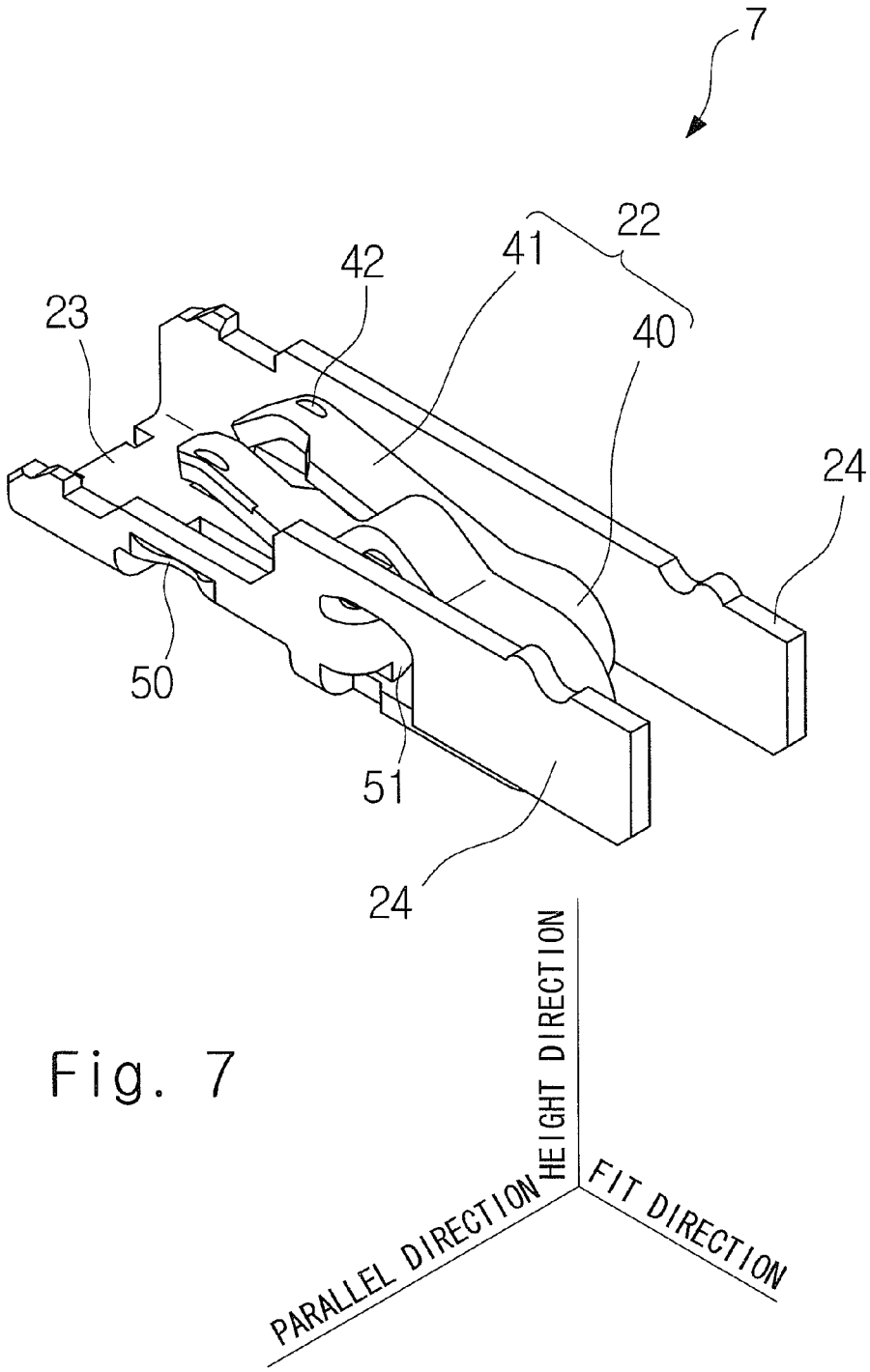
FIG. 7 is a perspective view of the detecting female contact seen from a different angle (first exemplary embodiment)

As shown in FIG. 7, the detecting normal spring piece 22 includes a folded part 40 and a V-shaped part 41.

The folded part 40 is a part connected to an end part of the bottom plate part 23 on the side of the female connector removal direction, and is a part in which the detecting normal spring piece 22 is folded by about 180 degrees to the side of the bottom plate apart direction.

The V-shaped part 41 is a part connected to the folded part 40, and bent substantially in an inverted V shape to the bottom plate apart direction. A contact part 42 that swells in a spherical shape to the bottom plate apart direction is formed on the surface that faces the opposite side from the bottom plate part 23 near the tip of the V-shaped part 41.

As shown in FIG. 5, a cutout 23*a* is formed in the bottom plate part 23 to prevent physical interference between the bottom plate part 23 and the front end part 33 of the detecting collision spring piece 21 when the detecting collision spring piece 21 is elastically deformed to the side of the bottom plate approach direction.

As shown in FIGS. 5 to 8, an interference part 50 and an excessive deformation preventing part 51 are formed in the side plate part 24 of the pair of side plate parts 24 that is on the side of the normal collision direction. In other words, the interference part 50 and the excessive deformation preventing part 51 are formed in the side plate part 24 of the pair of side plate parts 24 that is on the side close to the detecting collision spring piece 21.

Figure 8:
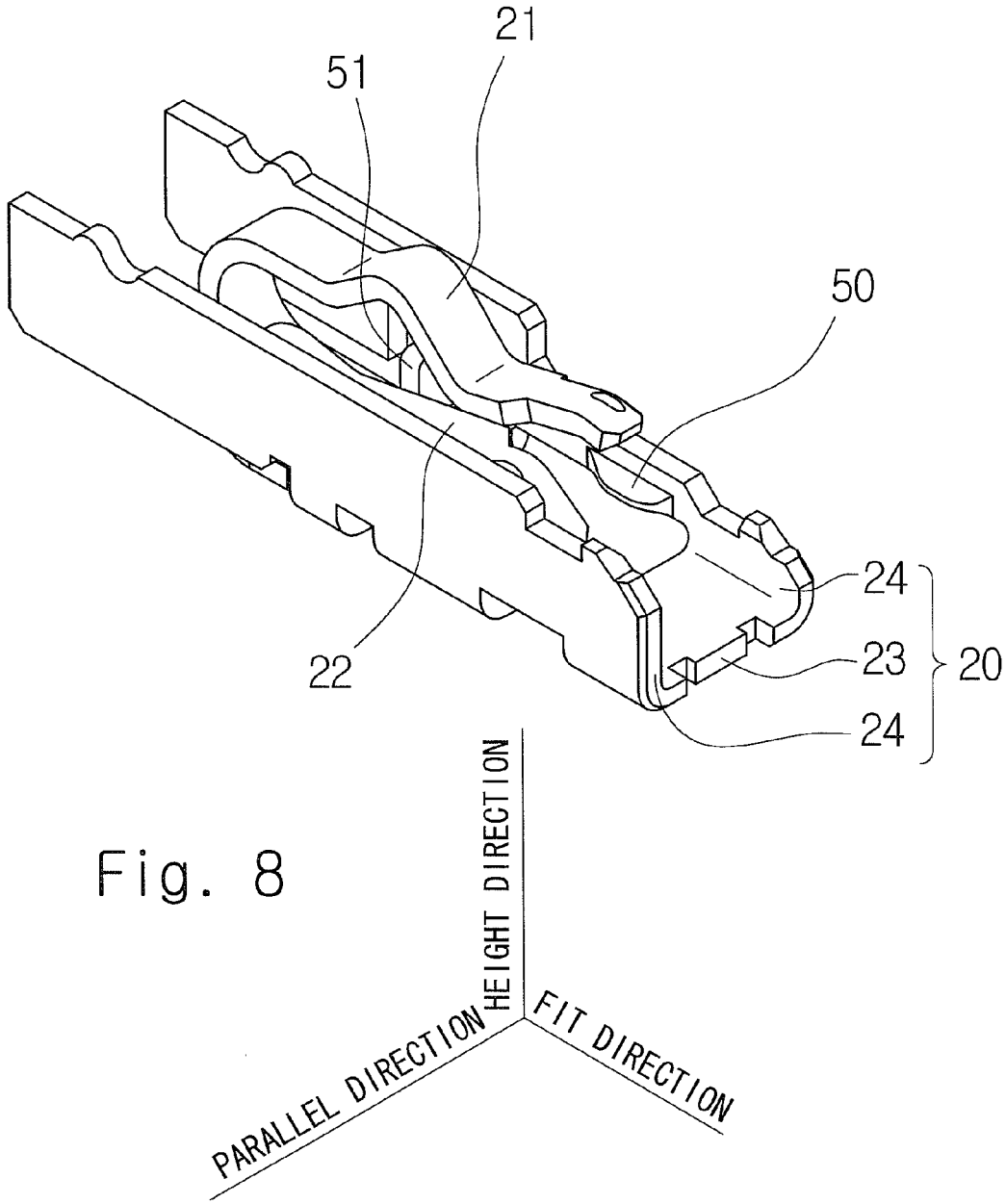
FIG. 8 is a perspective view of the detecting female contact seen from a different angle (first exemplary embodiment)

The interference part 50 is formed, as shown in FIGS. 6 to 8, to project from the side plate part 24 to the collision normal direction. As shown in FIG. 5, the interference part 50 is arranged on the side of the bottom plate approach direction when seen from the contact part 34 of the front end part 33 when seen from the parallel direction. As shown in FIG. 6, the interference part 50 is opposed to a part of the front end part 33 on the side of the normal collision direction in the height direction when seen from the mate direction. The interference part 50 includes a sloped surface 50*a* that is inclined with respect to the height direction. The sloped surface 50*a* is inclined so as to approach the bottom plate part 23 toward the collision normal direction. In the first exemplary embodiment, the sloped surface 50*a* is a curved surface that swells in a somewhat convex shape when seen from the mate direction. Alternatively, the sloped surface 50*a* may be a plane surface, or may be a curved surface that dents in a somewhat concave shape.

The excessive deformation preventing part 51 is formed, as shown in FIGS. 7 and 8, so as to project from the side plate part 24 to the collision normal direction. As shown in FIG. 5, the excessive deformation preventing part 51 is arranged on the side of the bottom plate approach direction when seen from the pressed part 32 when seen from the parallel direction. As shown in FIG. 6, the excessive deformation preventing part 51 is opposed to the pressed part 32 in the height direction when seen from the mate direction.

(Female Housing 5)

As shown in FIG. 9, the female housing 5 includes a female housing main body 60 and a lock arm 61.

In the female housing main body 60, the detecting female contact accommodating part 10 that accommodates the detecting female contact 7 and the like are formed.

The lock arm 61 is formed as a cantilever that is supported by the female housing main body 60 to be capable of being elastically deformed. The lock arm 61 is arranged on the side of the bottom plate apart direction when seen from the detecting female contact 7 accommodated in the detecting female contact accommodating part 10. The lock arm 61 connects to an end part of the female housing main body 60 on the side of the female connector insertion direction, and extends in the female connector removal direction.

The lock arm 61 includes an arm main body 62, a lock part 63, a pressing part 64, and an operation part 65.

The arm main body 62 is a part that serves as a base of the lock arm 61.

The lock part 63 is arranged in a middle part of the arm main body 62 in a longitudinal direction. The lock part 63 is arranged in the arm main body 62 on the side of the bottom plate apart direction. The lock part 63 includes a guide surface 63*a* and a lock surface 63*b*. The guide surface 63*a* is a sloped surface that inclines to the side of the bottom plate approach direction toward the female connector insertion direction. The lock surface 63*b* is a plane surface that is perpendicular to the mate direction.

The pressing part 64 is arranged in a middle part of the arm main body 62 in the longitudinal direction. The pressing part 64 is arranged in the arm main body 62 on the side of the bottom plate approach direction. The pressing part 64 is opposed to the pressed part 32 of the detecting female contact 7 in the height direction.

The operation part 65 is formed in an end part of the arm main body 62 on the side of the female connector removal direction.

(Male Connector 3)

As shown in FIG. 2, the male connector 3 includes a male housing 70 (second housing), a plurality of signal male contacts 71, and two pairs of detecting male contacts 72 (second contact). The plurality of signal male contacts 71 are held by the male housing 70, and contact with the socket contact attached to each cable 4. The two pairs of detecting male contacts 72 are held by the male housing 70, and contact with the detecting female contact 7 of the female connector 2. In summary, a pair of detecting male contacts 72 of the two pairs of detecting male contacts 72 contact with the detecting female contact 7 of one female connector 2, and the other pair of the detecting male contacts 72 contact with the detecting female contact 7 of the other female connector 2.

Figure 10:
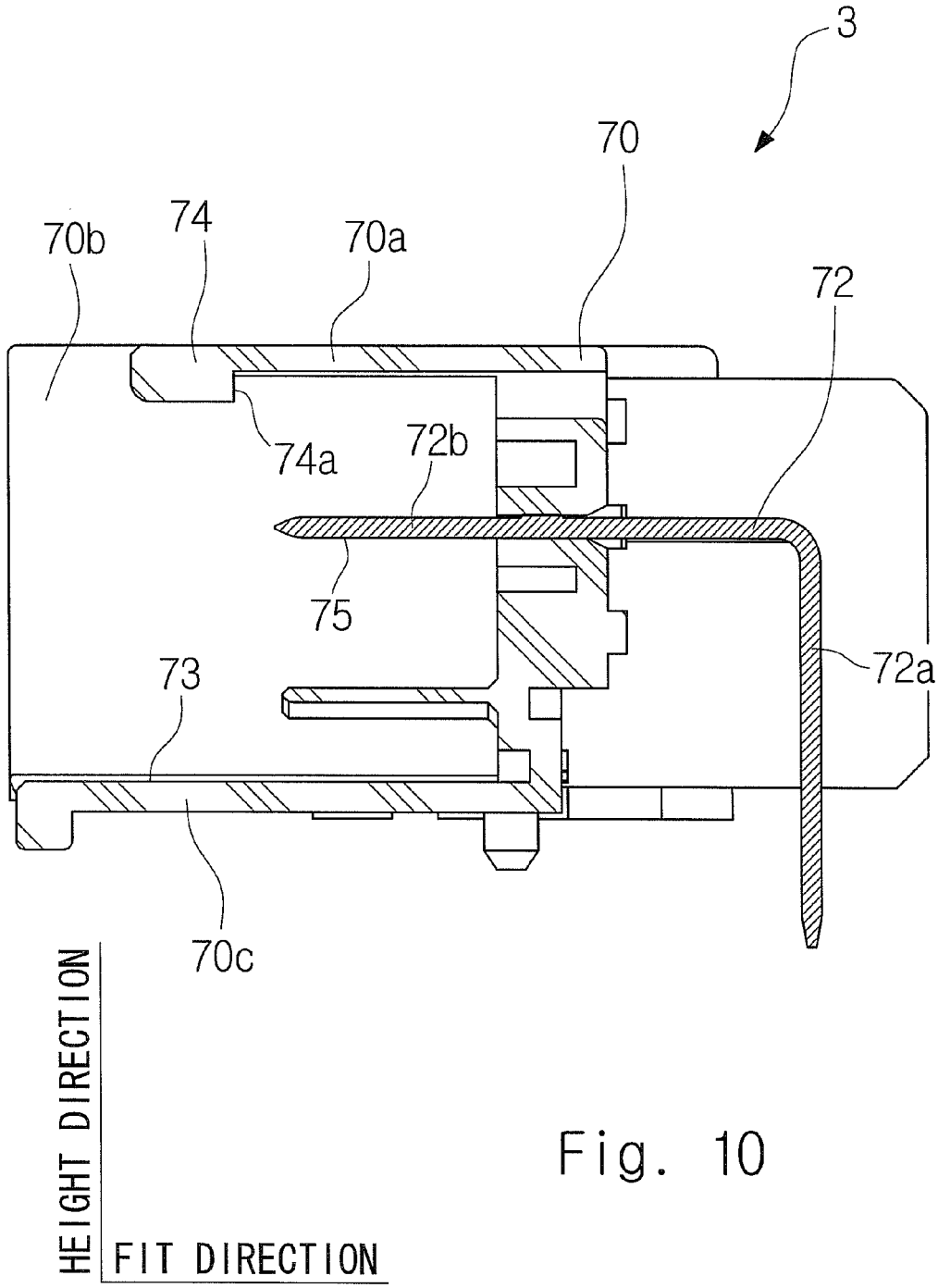
FIG. 10 is a cross-sectional side view of a male connector (first exemplary embodiment)

As shown in FIG. 10, in the male housing 70, a female connector accommodating part 73 into which the female connector 2 is inserted is formed. The female connector accommodating part 73 is opened in the female connector removal direction. The male housing 70 includes a top plate 70*a*, a pair of side plates 70*b*, and a bottom plate 70*c* that define the female connector accommodating part 73. The top plate 70*a* defines the side of the bottom plate apart direction of the female connector accommodating part 73. The pair of side plates 70*b* define the parallel direction side of the female connector accommodating part 73. The bottom plate 70*c* defines the side of the bottom plate approach direction of the female connector accommodating part 73.

A locked part 74 that projects into the side of the female connector accommodating part 73 is formed at an end of the top plate 70*a* of the male housing 70 on the side of the female connector removal direction. The locked part 74 includes a locked surface 74*a* that faces the female connector insertion direction. The locked surface 74*a* is a surface perpendicular to the mate direction.

The detecting male contact 72 includes a leg part 72*a* extending in parallel to the height direction, and a connection part 72*b* extending in parallel to the mate direction, and is formed to have a substantially L shape. The leg part 72*a* is a part soldered to a circuit board (not shown). The connection part 72*b* is a part that contacts with the detecting female contact 7 of the female connector 2. The connection part 72*b* includes a contact surface 75 that faces the bottom plate approach direction.

As shown in FIG. 2, the signal male contact 71 includes a leg part 71*a* extending in parallel to the height direction, and a connection part 71*b* extending in parallel to the mate direction, and is formed to have a substantially L shape. The leg part 71*a* is a part soldered to a circuit board (not shown). The connection part 71*b* is a part that contacts with the socket contact attached to each cable 4.

(Operations)

Next, with reference to FIGS. 11 to 19, operations of the airbag electrical connector 1 will be described.

Figure 11:
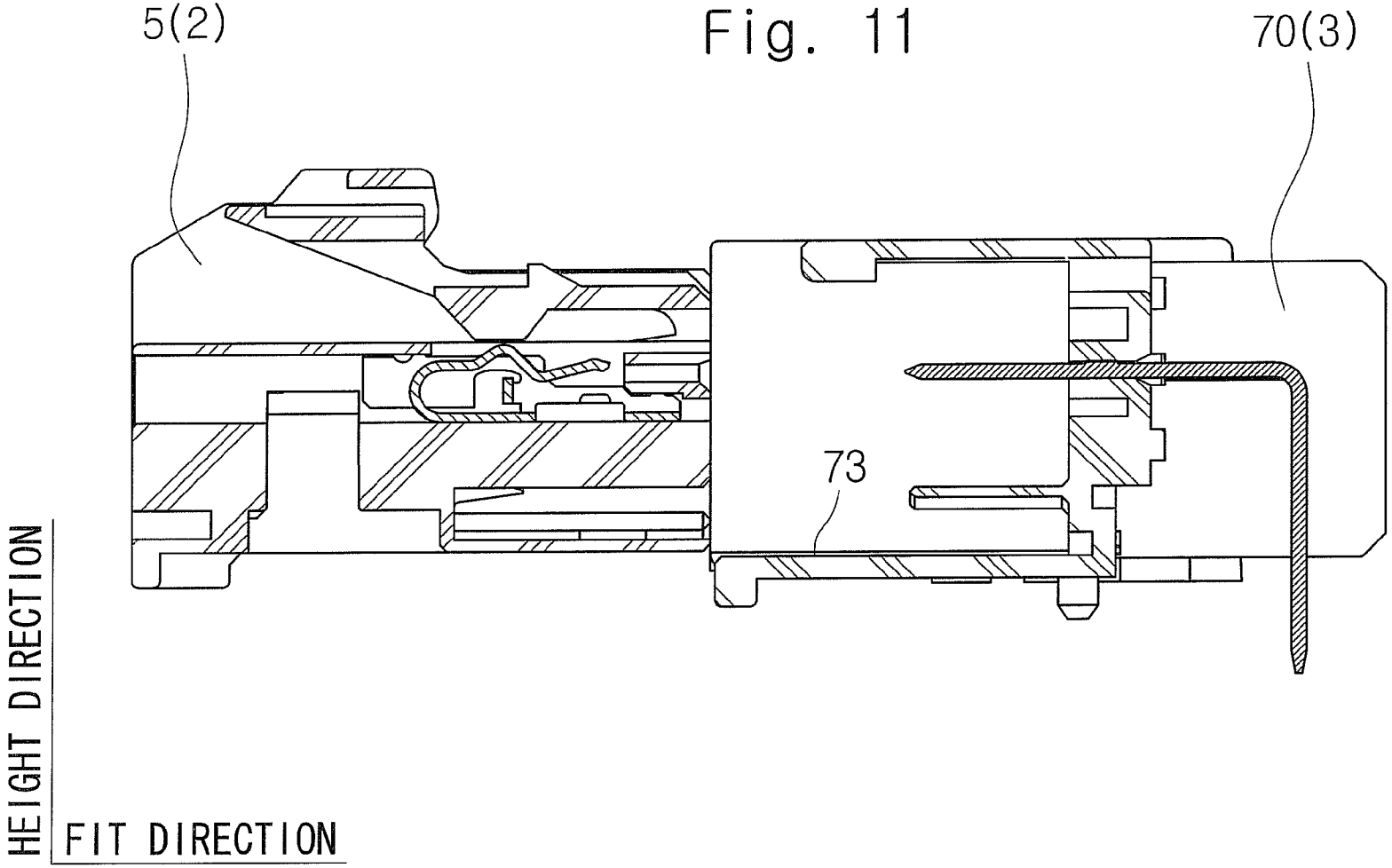
FIG. 11 shows a state in which the female connector and the male connector are opposed to each other (first exemplary embodiment)
Figure 12:
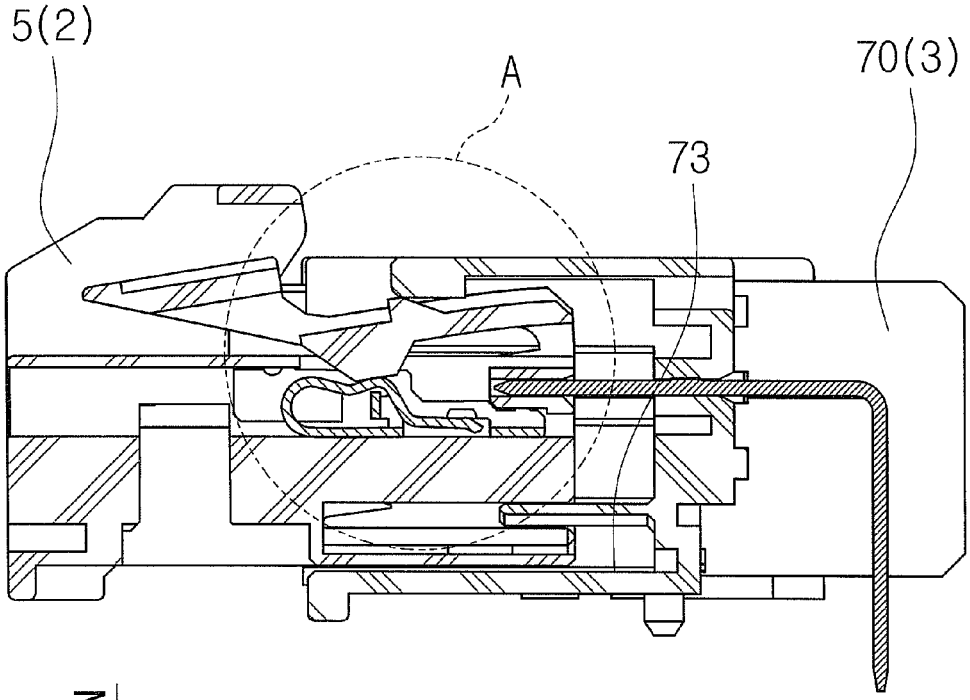
FIG. 12 shows a state in which a lock arm is pressed down (first exemplary embodiment)
Figure 12:
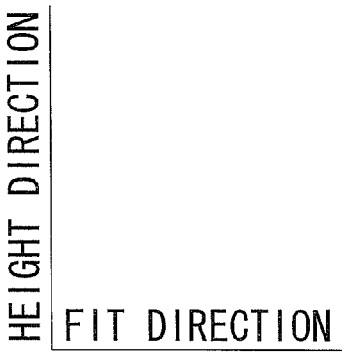
Figure 13:
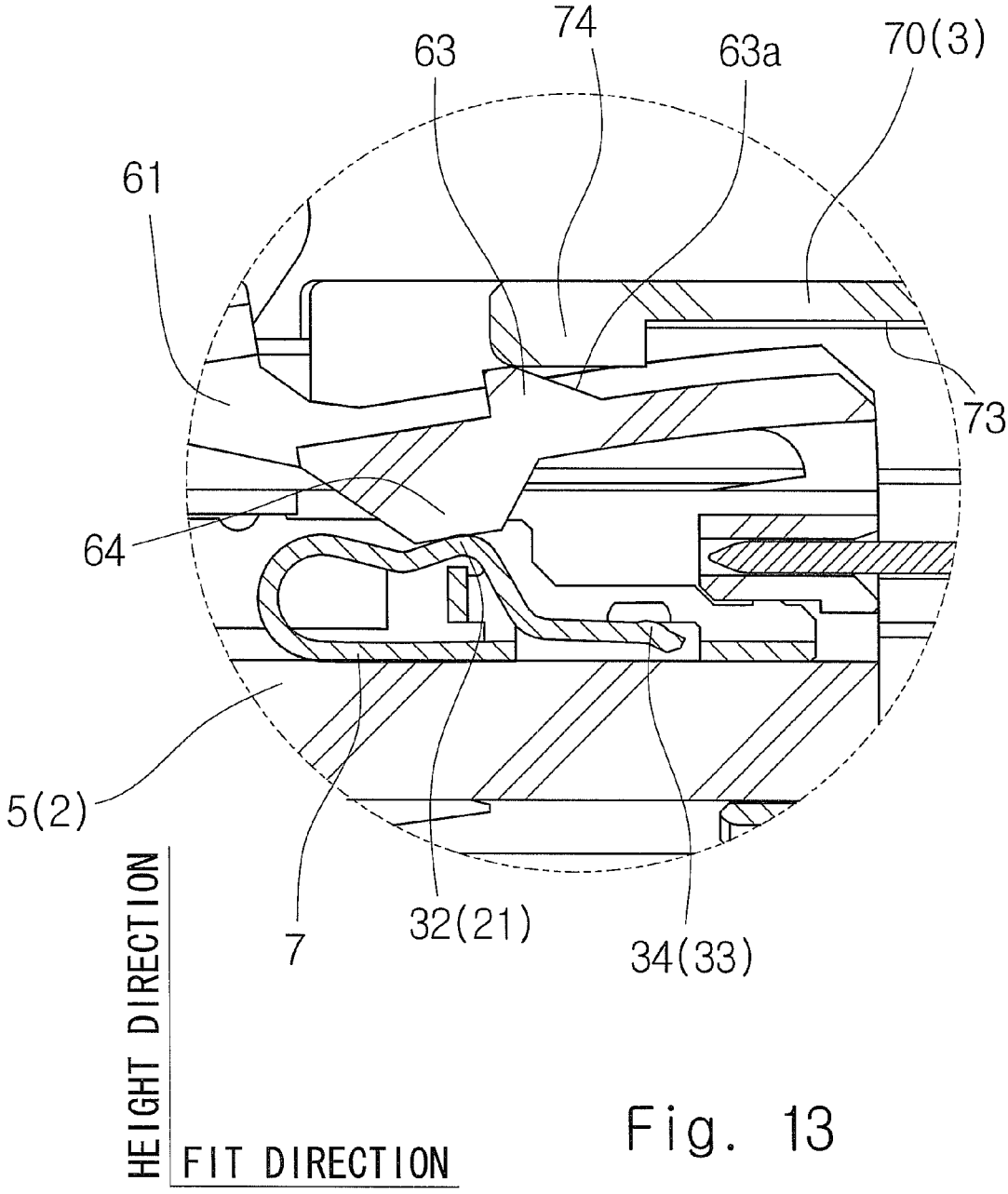
FIG. 13 is an enlarged view of an A part of FIG. 12 (first exemplary embodiment)

FIG. 11 shows a state before the female connector 2 is inserted into the female connector accommodating part 73 of the male connector 3. When the female housing 5 of the female connector 2 is inserted into the female connector accommodating part 73 of the male connector 3 from the state shown in FIG. 11 to a state shown in FIG. 12, the guide surface 63*a* of the lock part 63 of the lock arm 61 contacts with the locked part 74, and the lock part 63 slips under the locked part 74 to the side of the bottom plate approach direction as shown in FIG. 13. Since the lock part 63 slips under the locked part 74 to the side of the bottom plate approach direction, the pressing part 64 of the lock arm 61 is displaced to the bottom plate approach direction. When the pressing part 64 of the lock arm 61 is displaced to the bottom plate approach direction, the pressing part 64 contacts with the pressed part 32 of the detecting collision spring piece 21 of the detecting female contact 7, whereby the pressed part 32 is displaced to the bottom plate approach direction, and at the same time the contact part 34 is displaced to the bottom plate approach direction.

Figure 14:
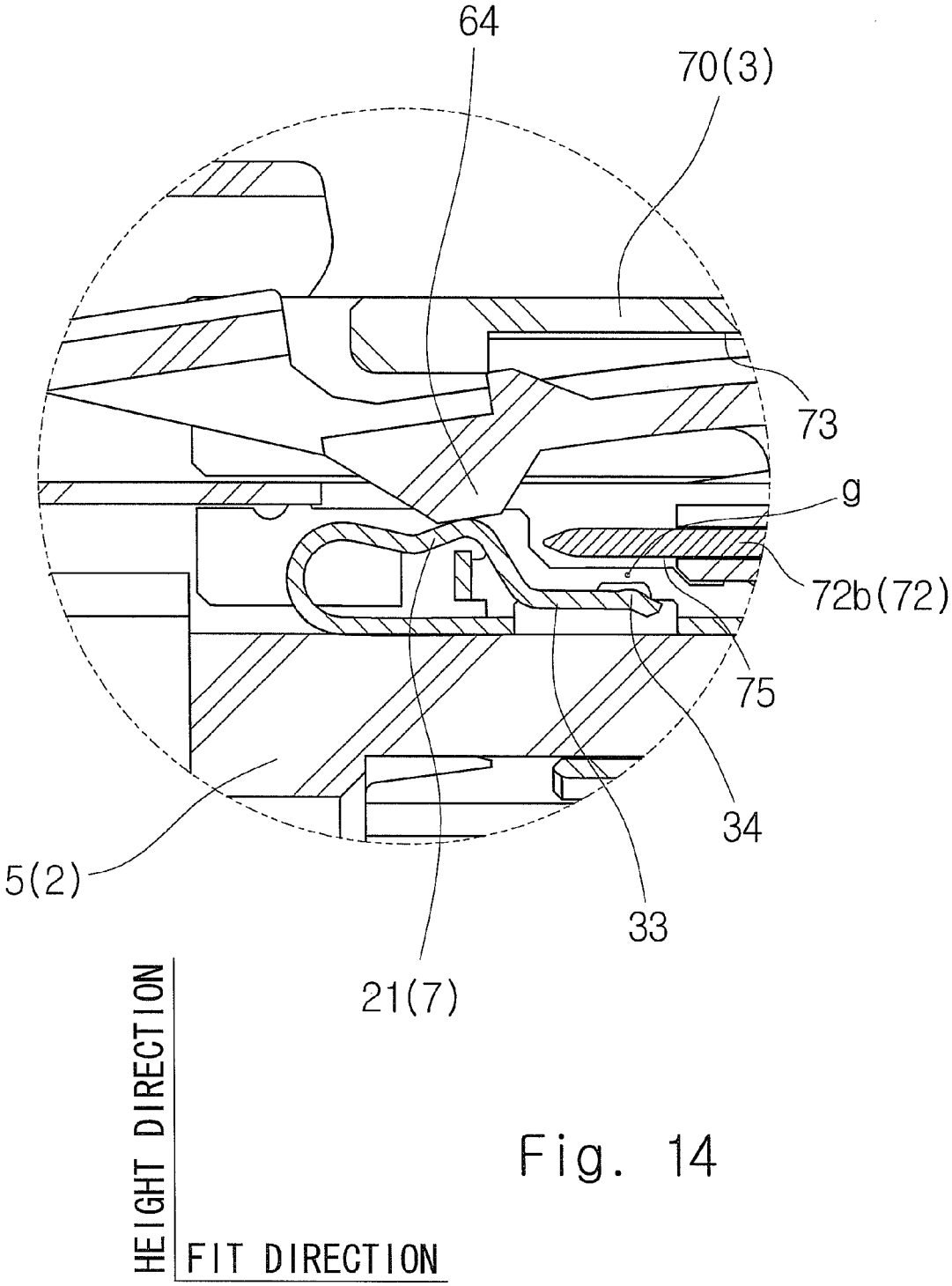
FIG. 14 is a diagram showing a state just before the female connector and the male connector are mated properly (first exemplary embodiment)

When the female housing 5 of the female connector 2 is further inserted into the female connector accommodating part 73 of the male connector 3 from the state shown in FIG. 13 to a state shown in FIG. 14, the contact part 34 of the detecting female contact 7 is opposed to the contact surface 75 of the connection part 72*b* of the detecting male contact 72 in the height direction. More specifically, the contact part 34 is positioned on the side of the bottom plate approach direction with respect to the contact surface 75. In short, as shown in FIG. 14, the detecting collision spring piece 21 is elastically deformed to the bottom plate approach direction so that a gap g is formed between the contact part 34 and the contact surface 75 when the contact part 34 is opposed to the contact surface 75.

Figure 15:
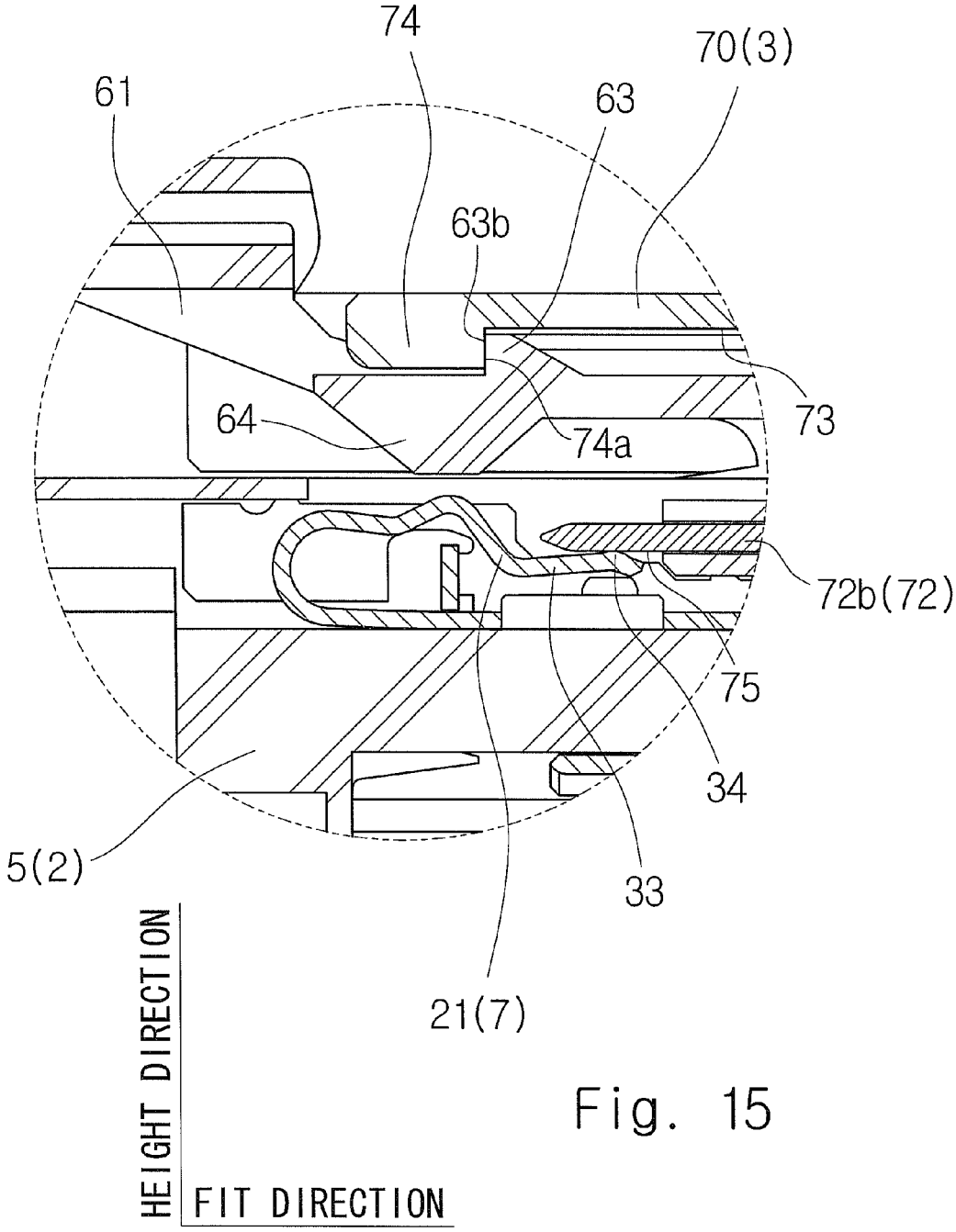
FIG. 15 is a diagram showing a state in which the female connector and the male connector are mated properly (first exemplary embodiment)

When the female housing 5 of the female connector 2 is further inserted into the female connector accommodating part 73 of the male connector 3 from the state shown in FIG. 14 to a state shown in FIG. 15, the lock part 63 of the lock arm 61 completely moves beyond the locked part 74, and the lock part 63 is restored to the bottom plate apart direction with a great force. At the same time, the lock surface 63*b* of the lock part 63 is opposed to the locked surface 74*a* in the mate direction, whereby the female housing 5 and the male housing 70 are mated properly. In short, the female connector 2 and the male connector 3 are mated properly.

When the lock part 63 is restored to the bottom plate apart direction with a great force, the pressing part 64 is also restored to the bottom plate apart direction with a great force at the same time. Then, an elastic deformation force that has elastically deformed the detecting collision spring piece 21 to the side of the bottom plate approach direction is released, resulting in that the detecting collision spring piece 21 is restored to the bottom plate apart direction with a great force due to a spring restoring force of the detecting collision spring piece 21. As a result, the contact part 34 collides with the contact surface 75, and the contact part 34 contacts with the contact surface 75. Since the contact part 34 contacts with the contact surface 75, the detecting male contact 72 and the detecting collision spring piece 21 of the detecting female contact 7 are conducted. In short, the detecting female contact 7 and the detecting male contact 72 are conducted.

When the female housing 5 is inserted into the female connector accommodating part 73 of the male housing 70 as shown in FIGS. 11 to 15, the detecting normal spring piece 22 of the detecting female contact 7 shown in FIG. 4 is elastically deformed to the side of the bottom plate approach direction due to the contact with the detecting male contact 72. In summary, when the contact part 22*a* of the detecting normal spring piece 22 contacts with the detecting male contact 72, the detecting normal spring piece 22 of the detecting female contact 7 is elastically deformed so as to be pushed away to the direction away from the detecting male contact 72 (bottom plate approach direction). In summary, since the contact point of the detecting male contact 72 is displaced in the mate direction, the detecting male contact 72 and the detecting normal spring piece 22 of the male housing 70 exert a wiping effect in the mate direction.

The detecting normal spring piece 22 and the detecting collision spring piece 21 of the detecting female contact 7 shown in FIG. 4 are connected through the bottom plate part 23. Accordingly, by checking the conduction between the detecting collision spring piece 21 of the detecting female contact 7 and the pair of detecting male contacts 72 that contact with the detecting normal spring piece 22, it can be detected whether the female connector 2 and the male connector 3 are mated properly.

Next, with reference to FIGS. 16 to 19, a locus of the elastic displacement of the contact part 34 of the front end part 33 when seen from the mate direction will be described in detail.

Figure 16:
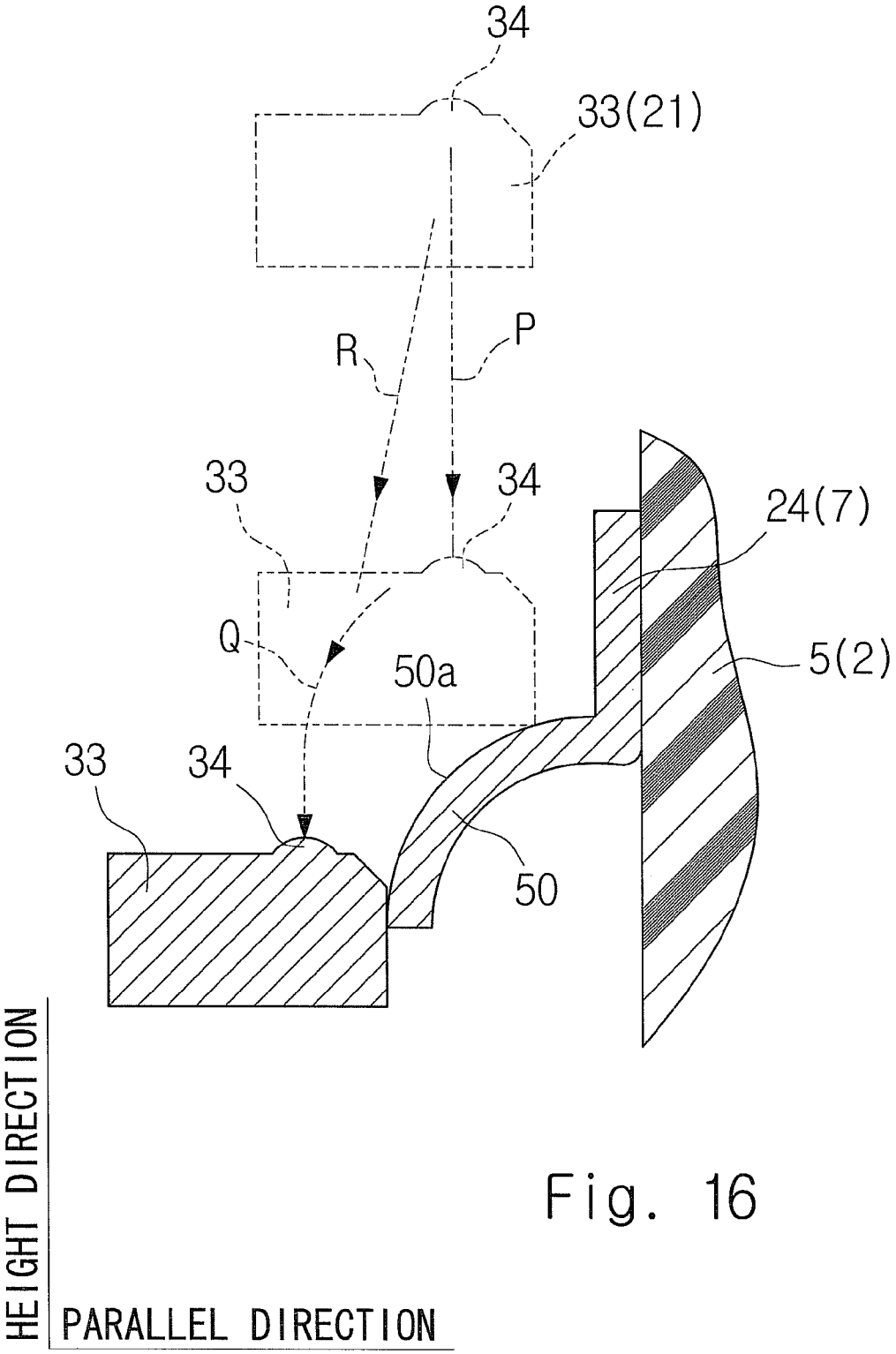
FIG. 16 is a diagram showing loci of a contact part when a detecting collision spring piece is elastically deformed by a lock arm (first exemplary embodiment)

According to the displacement of the pressing part 64 to the bottom plate approach direction as shown in FIG. 13, the contact part 34 is linearly displaced along the bottom plate approach direction until when the front end part 33 contacts with the sloped surface 50*a* of the interference part 50 as shown in FIG. 16. A locus P of the contact part 34 at this time is indicated by an alternate long and two short dashes line. Then, according to the further displacement of the pressing part 64 to the bottom plate approach direction, the front end part 33 is displaced in a substantially arc shape to slide on the sloped surface 50*a* along the sloped surface 50*a* of the interference part 50. A locus Q of the contact part 34 at this time is indicated by an alternate long and two short dashes line. The existence of this locus Q results in that the contact part 34 is elastically displaced to a direction different from the height direction when seen from the mate direction, as shown in a locus R indicated by an alternate long and two short dashes line. In summary, the contact part 34 is displaced not only to the bottom plate approach direction but also to the side of the collision normal direction compared to the state before displacement. In other words, the detecting collision spring piece 21 is elastically deformed to a direction different from the height direction when seen from the mate direction. As shown in FIG. 16, the height direction is equal to the plate thickness direction of the detecting collision spring piece 21.

Figure 17:
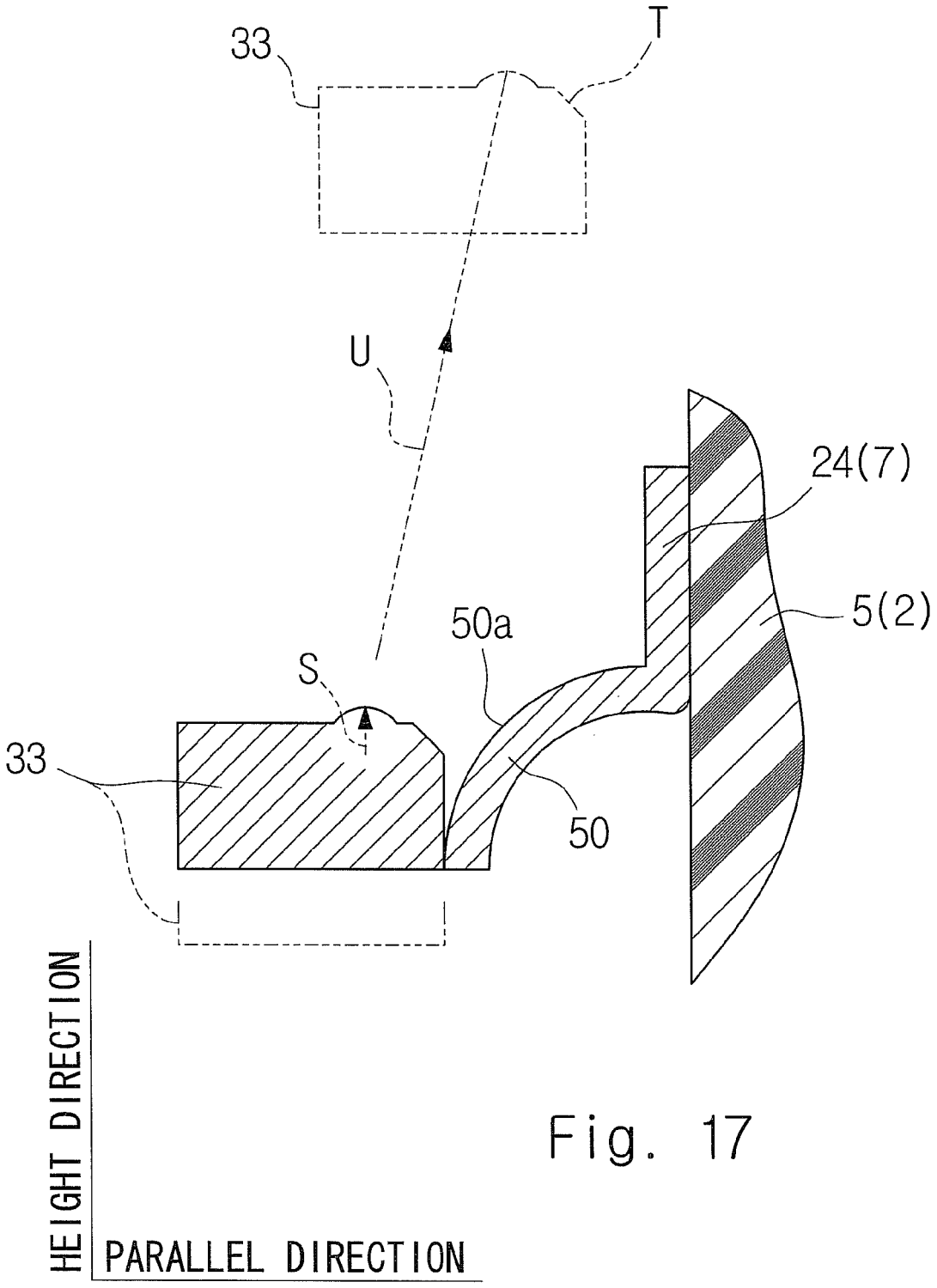
FIG. 17 is a diagram in which loci of the contact part are imaged when the female connector and the male connector are mated properly (first exemplary embodiment)

Next, when the pressing part 64 is displaced to the bottom plate apart direction with a great force according to the state in which the female connector 2 and the male connector 3 are mated properly as shown in FIGS. 14 and 15, the front end part 33 is linearly displaced to some extent to the bottom plate apart direction as shown in a locus S as shown in FIG. 17, and then the front end part 33 is apart from the sloped surface 50*a* of the interference part 50 and tends to linearly return to an original position T by a spring restoring force of the detecting collision spring piece 21. A locus U at this time is indicated by an alternate long and two short dashes line. The locus U is inclined with respect to the height direction when seen from the mate direction. In short, the locus U is inclined to the side of the normal collision direction toward the bottom plate apart direction when seen from the mate direction.

Figure 18:
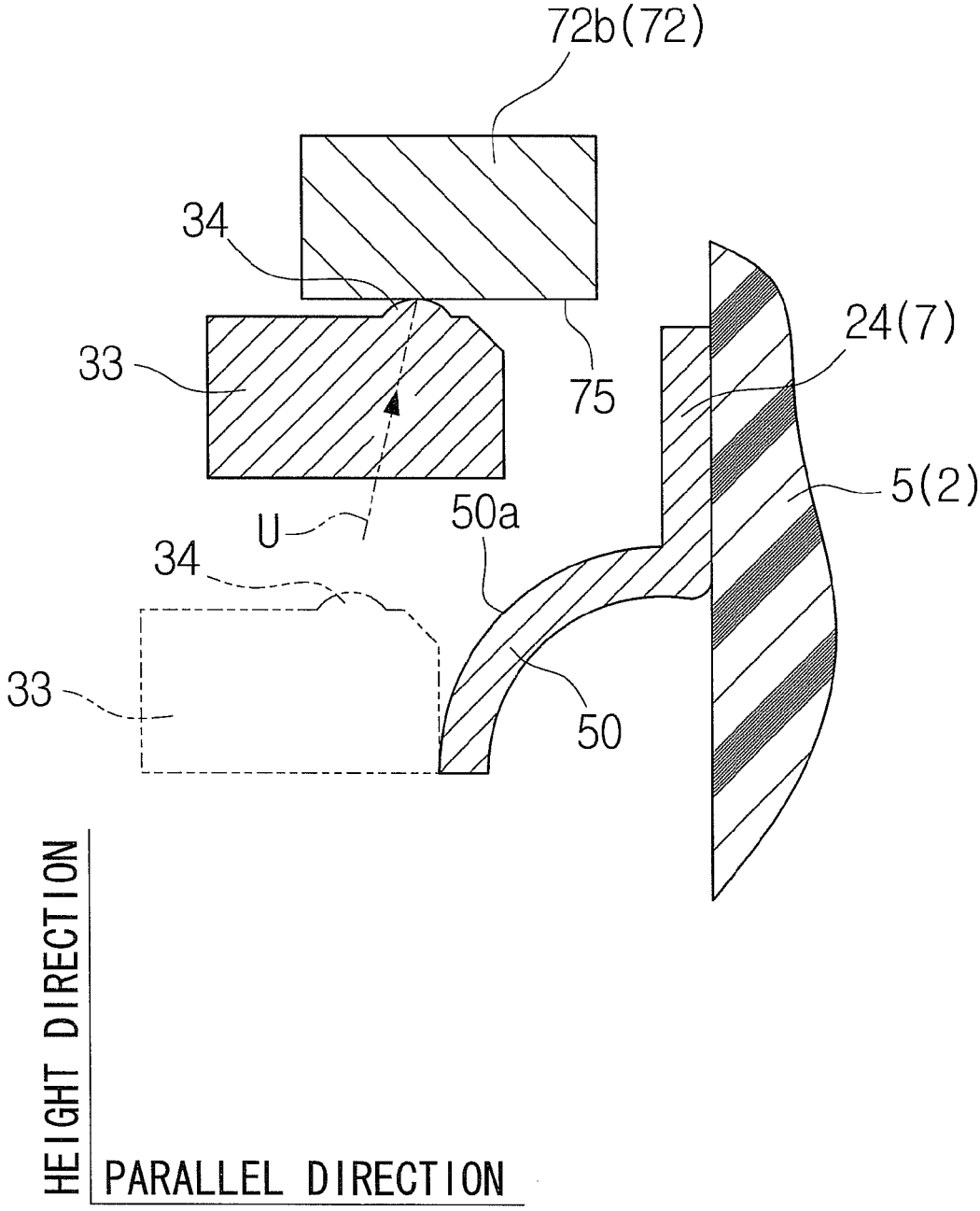
FIG. 18 is a diagram showing a locus of the contact part when the female connector and the male connector are mated properly (first exemplary embodiment)

However, in reality, as shown in FIG. 14, the connection part 72*b* of the detecting male contact 72 is positioned on the side of the bottom plate apart direction of the contact part 34 of the front end part 33. Accordingly, the contact part 34 of the front end part 33 starts to be restored along with the locus U described in FIG. 17, and obliquely collides with the contact surface 75 of the connection part 72*b* of the detecting male contact 72 as shown in FIG. 18. Note that, in the first exemplary embodiment, the contact surface 75 is perpendicular to the height direction.

Figure 19:
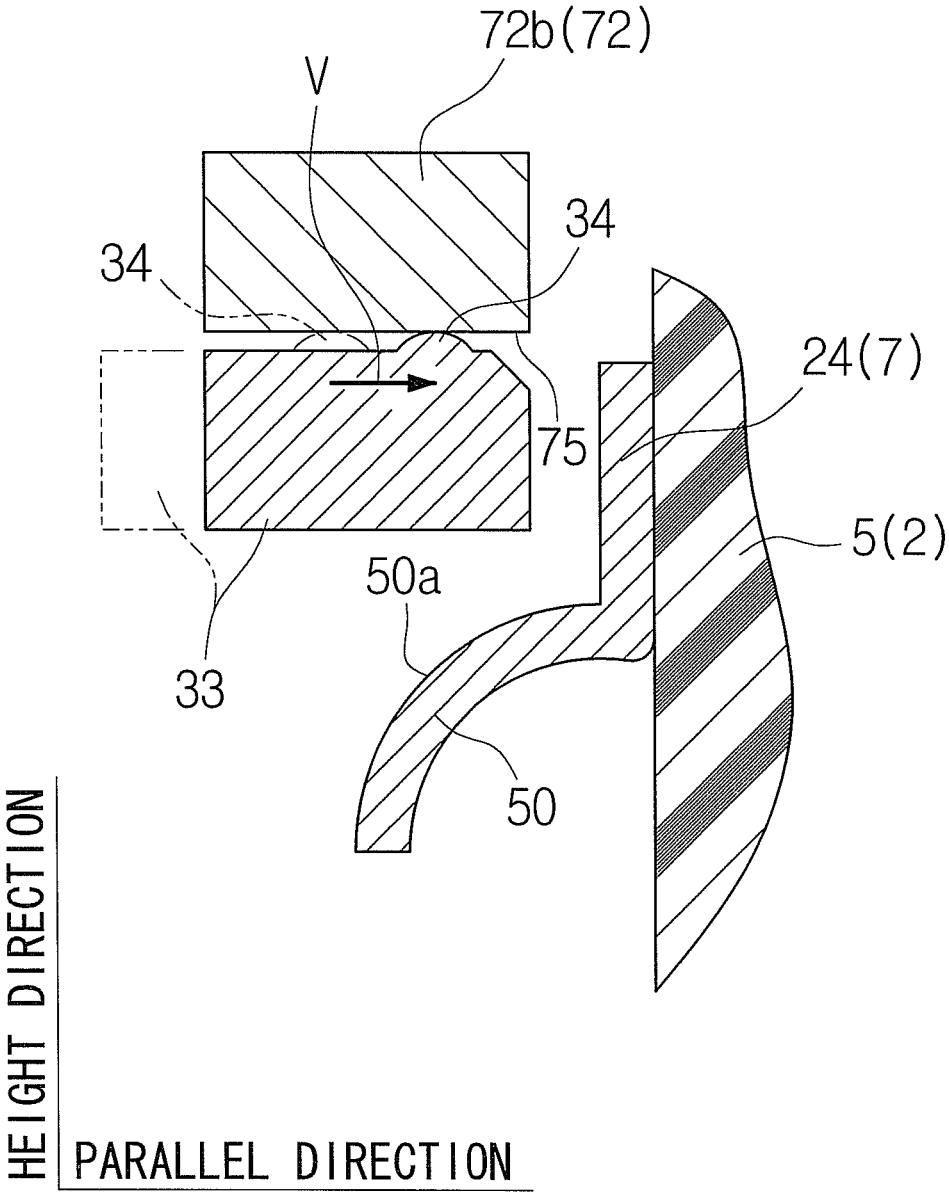
FIG. 19 is a diagram showing a locus of the contact part when the female connector and the male connector are mated properly, and shows a wiping operation in a parallel direction (first exemplary embodiment)

As shown in FIG. 18, instead of colliding with the contact surface 75 along a normal direction of the contact surface 75, the contact part 34 obliquely collides with the contact surface 75. Thus, as shown in FIG. 19, after this collision, the contact part 34 moves on the contact surface 75 in the normal collision direction (as shown by an arrow V) while being contacted with the contact surface 75. Due to this restoration, the contact part 34 and the contact surface 75 exert a so-called wiping effect in a parallel direction, which greatly improves contact reliability of the contact part 34 and the contact surface 75.

In the state shown in FIG. 19, the contact part 34 may be slightly slid repeatedly so as to reciprocate on the contact surface 75 along the parallel direction. In this case, the above wiping effect is further exerted, whereby the contact reliability of the contact part 34 and the contact surface 75 is further improved dramatically.

The first preferable exemplary embodiment of the present invention has been described above. In summary, the first exemplary embodiment has the following features.

(1) The airbag electrical connector 1 (electrical connector) includes the female connector 2 (first connector part) including the female housing 5 (first housing) and the detecting female contact 7 (first contact) held by the female housing 5, and the male connector 3 (second connector part) including the male housing 70 (second housing) and the detecting male contact 72 (second contact) held by the male housing 70. The airbag electrical connector 1 allows the female connector 2 and the male connector 3 to mate each other, whereby the detecting female contact 7 and the detecting male contact 72 are connected to each other. The detecting female contact 7 includes the holding part 20 held by the female housing 5, and the detecting collision spring piece 21 (spring piece) supported by the holding part 20 to be capable of being elastically deformed. The contact part 34 contacted to the detecting male contact 72 is formed in the detecting collision spring piece 21. The detecting male contact 72 includes the contact surface 75 contacted to the contact part 34. The detecting collision spring piece 21 is, as shown in FIG. 14, elastically deformed in advance so that the gap g is formed between the contact part 34 and the contact surface 75 when the contact part 34 is opposed to the contact surface 75 in the height direction. Further, as shown in FIGS. 14 and 15, when an elastic deformation force that elastically deforms the detecting collision spring piece 21 is released, the contact part 34 contacts with the contact surface 75 with the collision against the contact surface 75 by a spring restoring force of the detecting collision spring piece 21. Then, as shown in FIG. 18, the locus U of the contact part 34 just before the contact part 34 contacts (collides) with the contact surface 75 is oblique with respect to the contact surface 75 when seen from the mate direction. According to the structure as above, when the contact part 34 contacts with the contact surface 75, as shown in FIG. 19, the contact part 34 is displaced while being contacted with the contact surface 75. Accordingly, a so-called wiping effect is exerted, thereby obtaining high contact reliability between the detecting female contact 7 and the detecting male contact 72.

(2) Further, the detecting female contact 7 is formed by folding a metal plate. The contact part 34 is elastically displaced to a direction different from the plate thickness direction of the detecting collision spring piece 21 when seen from the mate direction (see the locus R in FIG. 16). According to the structure stated above, the locus U that is restored as shown in FIG. 18 is oblique with respect to the contact surface 75 when seen from the mate direction.

(3) Further, as shown in FIGS. 6 and 16, the detecting female contact 7 includes the interference part 50 that physically interferes with the detecting collision spring piece 21 when the detecting collision spring piece 21 is elastically deformed so that the gap g is formed between the contact part 34 and the contact surface 75 when the contact part 34 is opposed to the contact surface 75. In the interference part 50, the sloped surface 50*a* is formed that is inclined with respect to the height direction when seen from the mate direction and is able to contact with the front end part 33 of the detecting collision spring piece 21. According to the structure above, the contact part 34 is elastically displaced to a direction different from the plate thickness direction of the detecting collision spring piece 21 (see the locus R of FIG. 16) when seen from the mate direction.

In the first exemplary embodiment described above, the sloped surface 50*a* that is inclined with respect to the height direction when seen from the mate direction and is able to contact with the front end part 33 of the detecting collision spring piece 21 is formed in the interference part 50. Alternatively, a sloped surface that is inclined with respect to the height direction when seen from the mate direction and is able to contact with the interference part 50 may be formed in the front end part 33 of the detecting collision spring piece 21. In this case as well, the contact part 34 is elastically displaced to a direction different from the plate thickness direction of the detecting collision spring piece 21 when seen from the mate direction (see the locus R in FIG. 16).

(5) Further, as shown in FIG. 14, the male housing 70 includes the pressing part 64 that elastically deforms the detecting collision spring piece 21 so that the gap g is formed between the contact part 34 and the contact surface 75 when the contact part 34 is opposed to the contact surface 75. Then, as shown in FIGS. 14 and 15, when the female connector 2 and the male connector 3 are mated properly, the pressing part 64 is restored to the bottom plate apart direction, and the elastic deformation force is released. According to the structure stated above, by checking the conduction between the detecting female contact 7 and the detecting male contact 72, it can be detected whether the female connector 2 and the male connector 3 are mated properly.

(10) Further, as shown in FIG. 5, the airbag electrical connector 1 further includes the excessive deformation preventing part 51 that physically interferes with the detecting collision spring piece 21 when the detecting collision spring piece 21 is elastically deformed, to prevent excessive elastic deformation of the detecting collision spring piece 21.

(11) This excessive deformation preventing part 51 is formed in the detecting female contact 7.

Second Exemplary Embodiment

Next, with reference to FIG. 20, a second exemplary embodiment of the present invention will be described. In the second exemplary embodiment, the difference from the first exemplary embodiment will mainly be described, and overlapping description will be omitted as appropriate. Further, the same components corresponding to those in the first exemplary embodiment are denoted by the same reference symbols in principle.

In the first exemplary embodiment, as shown in FIGS. 14 and 16, the detecting female contact 7 includes the interference part 50 that physically interferes with the detecting collision spring piece 21 when the detecting collision spring piece 21 is elastically deformed so that the gap g is formed between the contact part 34 and the contact surface 75 when the contact part 34 is opposed to the contact surface 75. In the interference part 50, the sloped surface 50*a* that is inclined with respect to the height direction when seen from the mate direction and is able to contact with the front end part 33 of the detecting collision spring piece 21 is formed.

Figure 20:
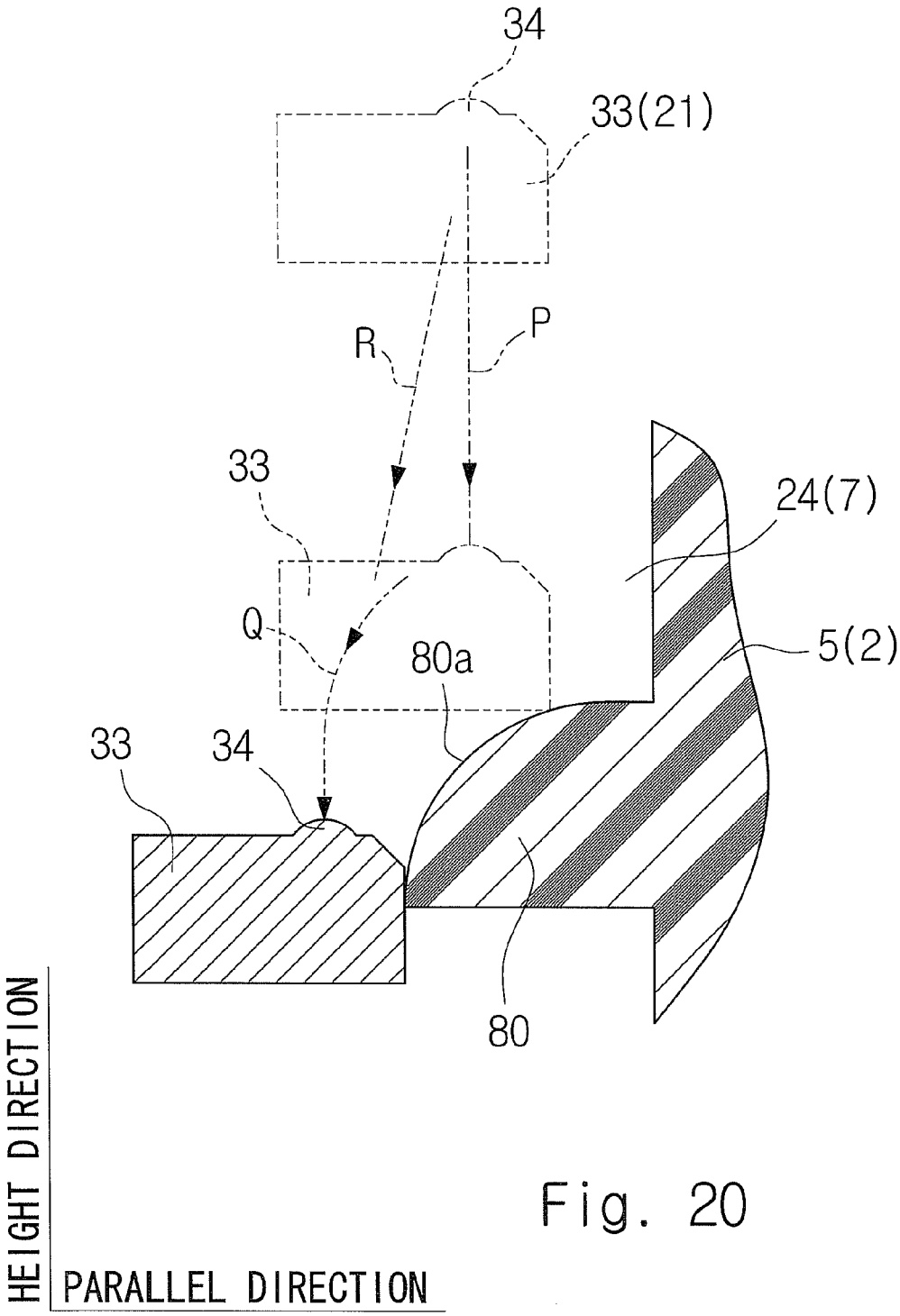
FIG. 20 is a diagram showing loci of a contact part when a detecting collision spring piece is elastically deformed by a lock arm (second exemplary embodiment)

(4) Meanwhile, in the second exemplary embodiment, as shown in FIG. 20, the female housing 5 includes an interference part 80 that physically interferes with the detecting collision spring piece 21 when the detecting collision spring piece 21 is elastically deformed so that the gap g is formed between the contact part 34 and the contact surface 75 when the contact part 34 is opposed to the contact surface 75. In the interference part 80, a sloped surface 80*a* is formed that is inclined with respect to the height direction when seen from the mate direction and is able to contact with the front end part 33 of the detecting collision spring piece 21. According to the structure stated above, the contact part 34 is elastically displaced to a direction different from the plate thickness direction of the detecting collision spring piece 21 when seen from the mate direction.

Instead of forming in the interference part 80 the sloped surface 80*a* that is inclined with respect to the height direction when seen from the mate direction and is able to contact with the front end part 33 of the detecting collision spring piece 21, a sloped surface that is inclined with respect to the height direction when seen from the mate direction and is able to contact with the interference part 80 may be formed in the front end part 33 of the detecting collision spring piece 21. In this case as well, the contact part 34 is elastically displaced to a direction different from the plate thickness direction of the detecting collision spring piece 21 when seen from the mate direction.

Third Exemplary Embodiment

Figure 21:
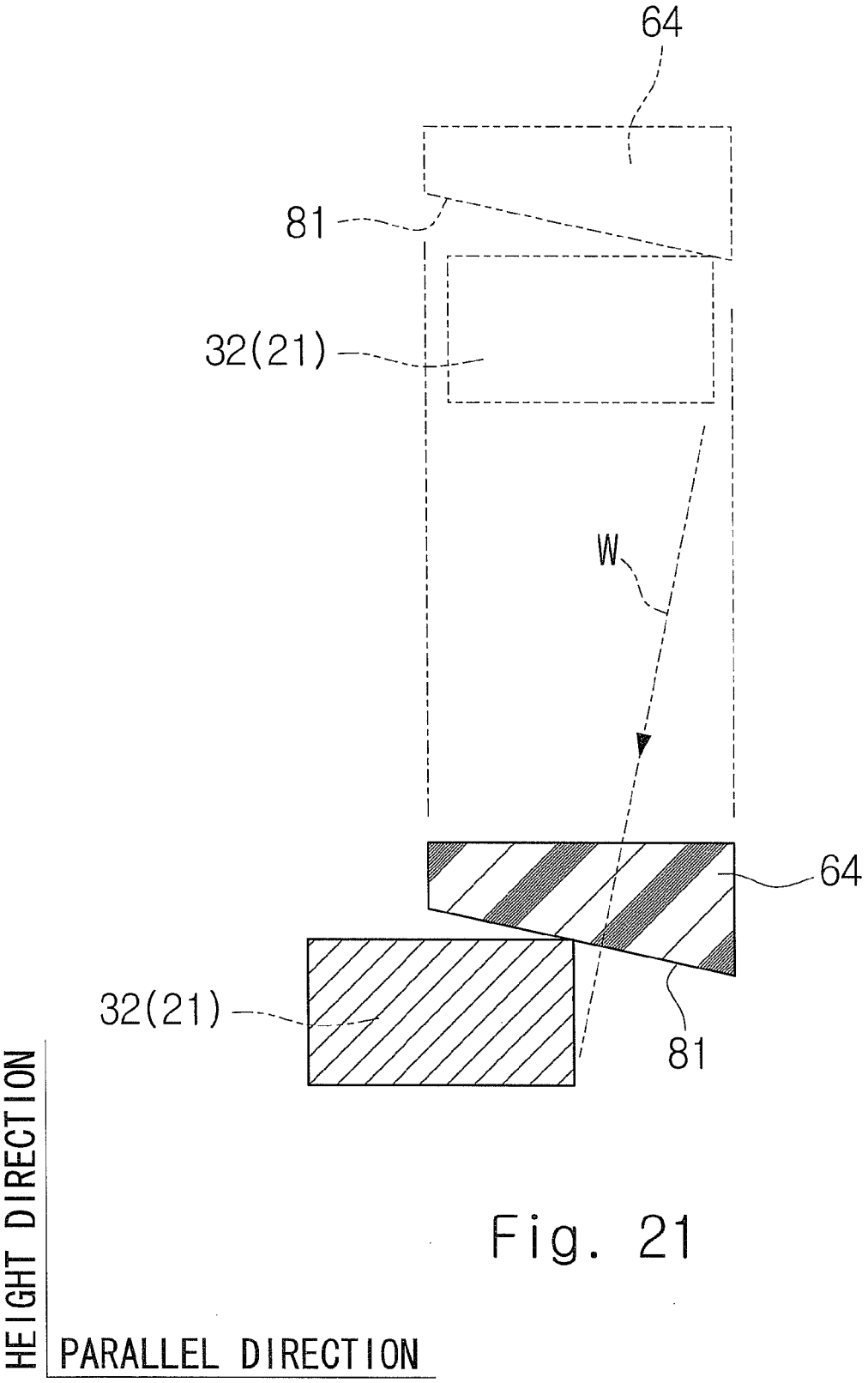
FIG. 21 is a diagram showing a locus of a contact part when a detecting collision spring piece is elastically deformed by a lock arm (third exemplary embodiment)

Next, with reference to FIG. 21, a third exemplary embodiment of the present invention will be described. In the third exemplary embodiment, the difference from the first exemplary embodiment will mainly be described, and overlapping description will be omitted as appropriate. Further, the same components corresponding to those in the first exemplary embodiment are denoted by the same reference symbols in principle.

In the first exemplary embodiment described above, as shown in FIG. 16, the detecting female contact 7 includes the interference part 50 that physically interferes with the detecting collision spring piece 21 when the detecting collision spring piece 21 is elastically deformed so that the gap g is formed between the contact part 34 and the contact surface 75 when the contact part 34 is opposed to the contact surface 75. In the interference part 50, the sloped surface 50*a* that is inclined with respect to the height direction when seen from the mate direction and is able to contact with the front end part 33 of the detecting collision spring piece 21 is formed. Note that, in the third exemplary embodiment, the contact surface 75 is perpendicular to the height direction.

(6) Meanwhile, according to the third exemplary embodiment, as shown in FIG. 14, the female housing 5 includes the pressing part 64 that elastically deforms the detecting collision spring piece 21 so that the gap g is formed between the contact part 34 and the contact surface 75 when the contact part 34 is opposed to the contact surface 75. Then, in the pressing part 64, as shown in FIG. 21, a sloped surface 81 that is inclined with respect to the height direction when seen from the mate direction and is able to contact with the pressed part 32 of the detecting collision spring piece 21 is formed. According to the structure stated above, the pressed part 32 is elastically displaced to a direction different from the height direction when seen from the mate direction. A locus W of the elastic displacement of the contact part 34 is indicated by an alternate long and two short dashes line. As a result, the contact part 34 is elastically displaced to a direction different from the height direction when seen from the mate direction.

Instead of forming in the pressing part 64 the sloped surface 81 that is inclined with respect to the height direction when seen from the mate direction and is able to contact with the pressed part 32 of the detecting collision spring piece 21, a sloped surface that is inclined with respect to the height direction when seen from the mate direction and is able to contact with the pressing part 64 may be formed in the pressed part 32 of the detecting collision spring piece 21. In this case as well, the pressed part 32 is elastically displaced to a direction different from the height direction when seen from the mate direction. As a result, the contact part 34 is elastically displaced to a direction different from the height direction when seen from the mate direction.

(7) Further, as shown in FIGS. 14 and 15, when the female connector 2 and the male connector 3 are mated properly, the pressing part 64 is restored to the bottom plate apart direction and the elastic deformation force is released. According to the structure stated above, by checking the conduction of the detecting female contact 7 and the detecting male contact 72, it is possible to detect whether the female connector 2 and the male connector 3 are mated properly.

Fourth Exemplary Embodiment

Figure 22:
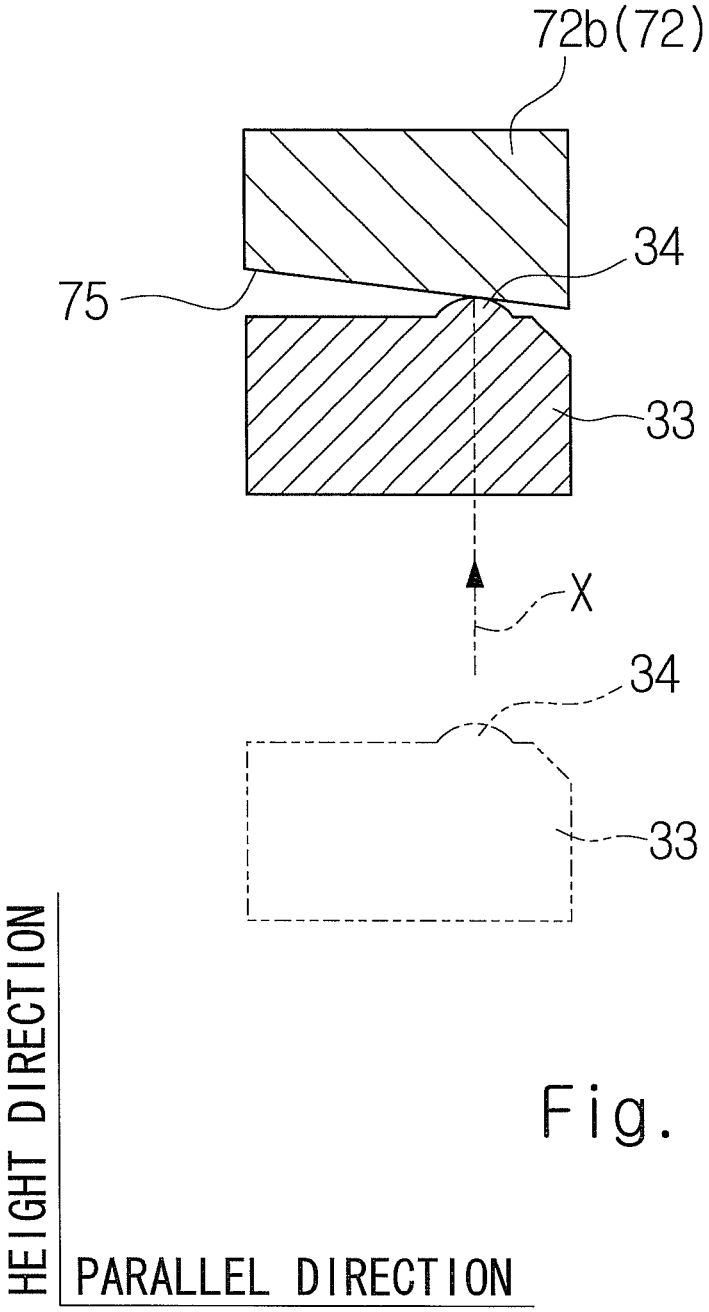
FIG. 22 is a diagram showing a locus of a contact part when a female connector and a male connector are mated properly, and shows a collision angle (fourth exemplary embodiment)
Figure 23:
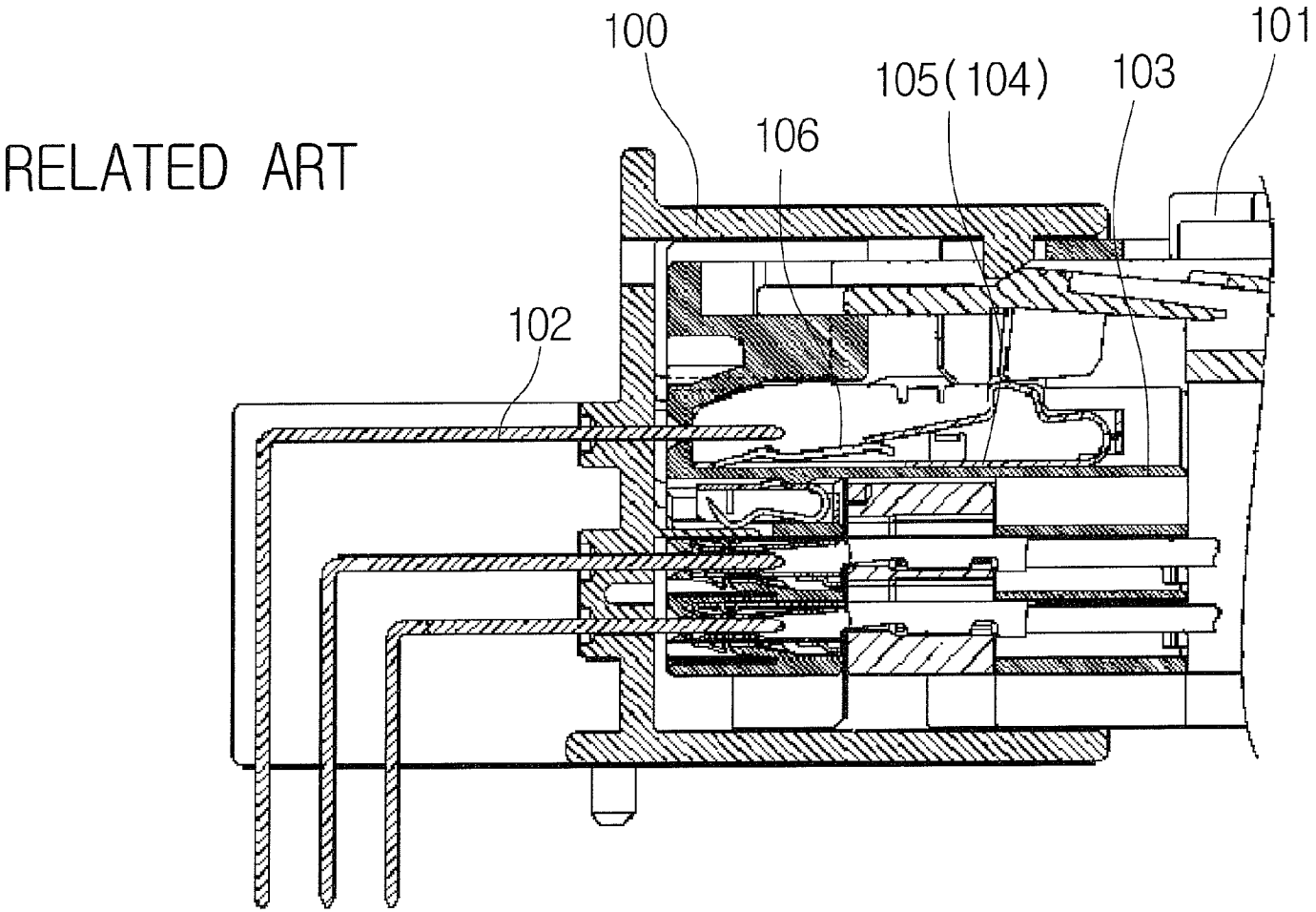
RELATED ART Fig. 23
FIG. 23 is a diagram corresponding to FIG. 4 of Japanese Unexamined Patent Application Publication No. 2007-123232.
Figure 24:
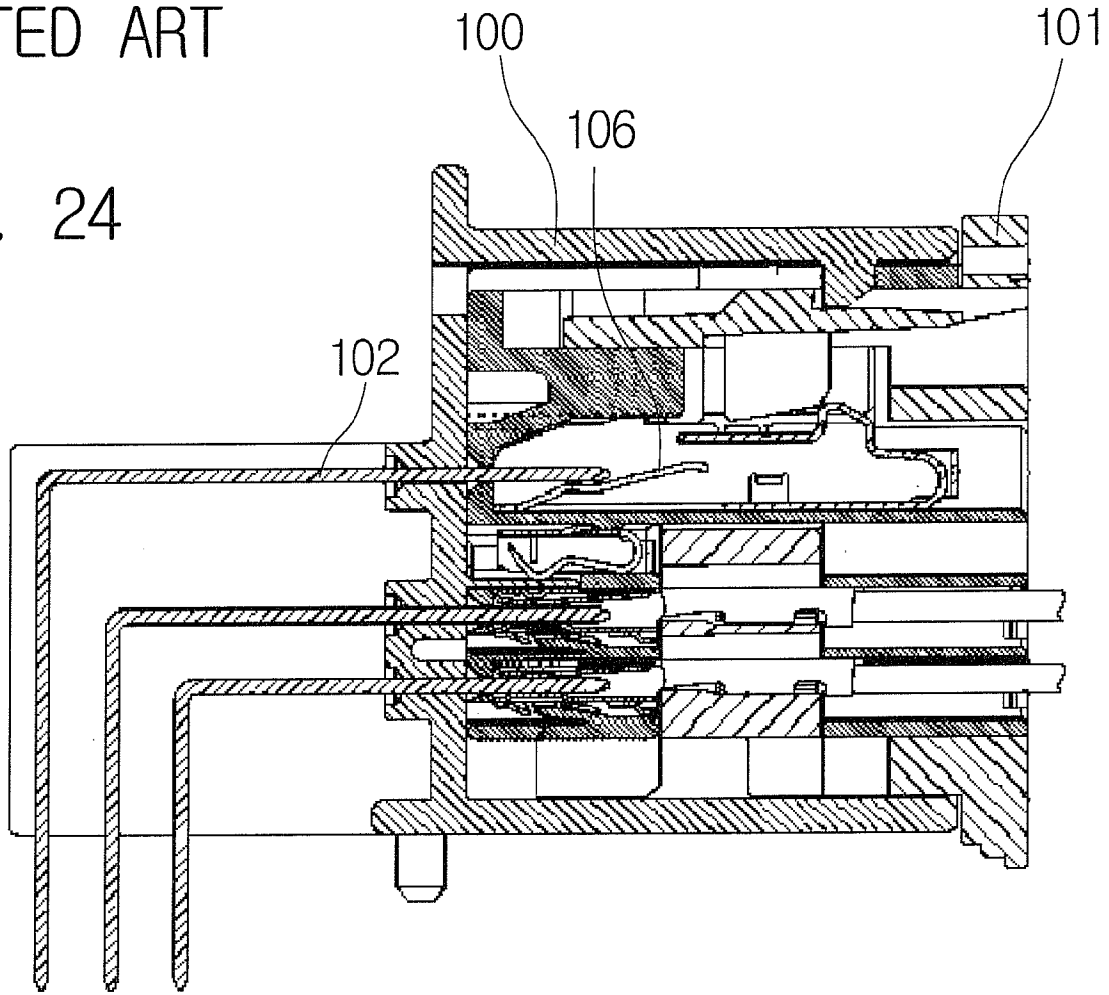
RELATED ART Fig. 24
FIG. 24 is a diagram corresponding to FIG. 6 of Japanese Unexamined Patent Application Publication No. 2007-123232.

Next, with reference to FIG. 22, a fourth exemplary embodiment of the present invention will be described. In the fourth exemplary embodiment, the difference from the first exemplary embodiment will mainly be described, and overlapping description will be omitted as appropriate. Further, the same components corresponding to those in the first exemplary embodiment are denoted by the same reference symbols in principle.

In the first exemplary embodiment described above, as shown in FIG. 16, the detecting female contact 7 includes the interference part 50 that physically interferes with the detecting collision spring piece 21 when the detecting collision spring piece 21 is elastically deformed so that the gap g is formed between the contact part 34 and the contact surface 75 when the contact part 34 is opposed to the contact surface 75. In the interference part 50, the sloped surface 50*a* that is inclined with respect to the height direction when seen from the mate direction and is able to contact with the front end part 33 of the detecting collision spring piece 21 is formed.

On the other hand, in the fourth exemplary embodiment, the interference part 50 described above is omitted. Instead, as shown in FIG. 22, the contact surface 75 of the connection part 72*b* of the detecting male contact 72 is inclined with respect to the height direction when seen from the mate direction. In this case as well, as is similar to FIG. 18, as shown in FIG. 22, the locus X of the contact part 34 just before the contact part 34 collides with the contact surface 75 is oblique with respect to the contact surface 75 when seen from the mate direction.

The fourth preferable exemplary embodiment of the present invention has been described above. In summary, the fourth exemplary embodiment has the following features.

(8) The detecting female contact 7 is formed by folding a metal plate. The contact surface 75 of the detecting male contact 72 is inclined with respect to the height direction when seen from the mate direction. According to the structure above, the locus X is oblique with respect to the contact surface 75 when seen from the mate direction.

(9) Further, the female housing 5 includes the pressing part 64 that elastically deforms the detecting collision spring piece 21 so that the gap g is formed between the contact part 34 and the contact surface 75 when the contact part 34 is opposed to the contact surface 75. When the female connector 2 and the male connector 3 are mated properly, the pressing part 64 is restored and the elastic deformation force is released. According to the structure stated above, the conduction between the detecting female contact 7 and the detecting male contact 72 is checked, thereby being able to detect whether the female connector 2 and the male connector 3 are mated properly.

From the invention thus described, it will be obvious that the embodiments of the invention may be varied in many ways. Such variations are not to be regarded as a departure from the spirit and scope of the invention, and all such modifications as would be obvious to one skilled in the art are intended for inclusion within the scope of the following claims.

What is claimed is:

1. An electrical connector comprising:

a first connector part comprising a first housing, and a first contact held by the first housing; and a second connector part comprising a second housing, and a second contact held by the second housing, wherein the first connector part and the second connector part are mated to make the first contact and the second contact each other, the first contact comprises a holding part held by the first housing and a spring piece supported by the holding part to be capable of being elastically deformed, a contact part that contacts with the second contact is formed in the spring piece, the second contact comprises a contact surface that contacts with the contact part, the spring piece is elastically deformed before the contact part is opposed to the contact surface, so that a gap is formed between the contact part and the contact surface when the contact part is opposed to the contact surface, the contact part is displaced toward the contact surface and contacts with the contact surface when an elastic deformation force that elastically deforms the spring piece is released, and just before the contact part contacts with the contact surface, the contact part is displaced obliquely with respect to the contact surface when seen from a mate direction as a direction of relative displacement of the second connector part seen from the first connector part when the first connector part and the second connector part are mated.

2. The electrical connector according to claim 1, wherein the first contact is formed by folding a metal plate, and before the contact part is opposed to the contact surface, the contact part is elastically displaced to a direction different from a plate thickness direction of the spring piece when seen from the mate direction so that the gap is formed between the contact part and the contact surface when the contact part is opposed to the contact surface.

3. The electrical connector according to claim 2, wherein the first contact comprises an interference part that physically interferes with the spring piece when the spring piece is elastically deformed so that the gap is formed between the contact part and the contact surface when the contact part is opposed to the contact surface, and a sloped surface that is inclined with respect to the plate thickness direction of the spring piece when seen from the mate direction is formed in at least one of the spring piece and the interference part, the sloped surface being able to contact with the other one of the spring piece and the interference part.

4. The electrical connector according to claim 2, wherein the first housing comprises an interference part that physically interferes with the spring piece when the spring piece is elastically deformed so that the gap is formed between the contact part and the contact surface when the contact part is opposed to the contact surface, and a sloped surface that is inclined with respect to the plate thickness direction of the spring piece when seen from the mate direction is formed in at least one of the spring piece and the interference part, the sloped surface being able to contact with the other one of the spring piece and the interference part.

5. The electrical connector according to claim 1, wherein the first housing comprises a pressing part that elastically deforms the spring piece so that the gap is formed between the contact part and the contact surface when the contact part is opposed to the contact surface, and the pressing part is restored and the elastic deformation force is released when the first connector part and the second connector part are mated properly.

6. The electrical connector according to claim 2, wherein the first housing comprises a pressing part that elastically deforms the spring piece so that the gap is formed between the contact part and the contact surface when the contact part is opposed to the contact surface, and a sloped surface that is inclined with respect to the plate thickness direction of the spring piece when seen from the mate direction is formed in at least one of the spring piece and the pressing part, the sloped surface being able to contact with the other one of the spring piece and the pressing part.

7. The electrical connector according to claim 6, wherein the pressing part is restored and the elastic deformation force is released when the first connector part and the second connector part are mated properly.

8. The electrical connector according to claim 1, wherein the first contact is formed by folding a metal plate, and a normal direction of the contact surface of the second contact is inclined with respect to a plate thickness direction of the spring piece when seen from the mate direction.

9. The electrical connector according to claim 8, wherein the first housing comprises a pressing part that elastically deforms the spring piece so that the gap is formed between the contact part and the contact surface when the contact part is opposed to the contact surface, and the pressing part is restored and the elastic deformation force is released when the first connector part and the second connector part are mated properly.

10. The electrical connector according to claim 1, further comprising an excessive deformation preventing part that physically interferes with the spring piece when the spring piece is elastically deformed to prevent excessive elastic deformation of the spring piece.

11. The electrical connector according to claim 10, wherein the excessive deformation preventing part is formed in the first contact.

12. The electrical connector according to claim 1, wherein the holding part comprises a bottom plate part.

13. The electrical connector according to claim 1, wherein the holding part comprises a bottom plate part and a pair of side plate parts connected to the bottom plate part to form a U shape when seen from the mate direction.

14. The electrical connector according to claim 12, wherein a cutout is formed in the bottom plate part to prevent physical interference between the spring piece and the bottom plate part when the spring piece is elastically deformed so that the gap is formed between the contact part and the contact surface when the contact part is opposed to the contact surface.

15. The electrical connector according to claim 1, wherein the first contact further comprises a second spring piece supported by the holding part to be capable of being elastically deformed, a contact part that contacts with a mating contact is formed in the second spring piece, and the second spring piece is elastically deformed to be pushed away to a direction away from the mating contact when the contact part of the second spring piece contacts with the mating contact.

16. The electrical connector according to claim 5, wherein the holding part of the first contact comprises a bottom plate part, and the spring piece comprises a pressed part pressed by the pressing part and a front end part having the contact part formed therein in series from the bottom plate part.

* * * * *